US008475992B2

(12) United States Patent
Morris et al.

(10) Patent No.: US 8,475,992 B2
(45) Date of Patent: Jul. 2, 2013

(54) TONER COMPRISING POLYESTER, PROCESS FOR MAKING THE TONER AND USES THEREOF

(75) Inventors: Daniel Patrick Morris, Manchester (GB); John Dylan Morgan, Manchester (GB); Martin Russell Edwards, Manchester (GB); Miguel Angel Rodriguez-Vazquez, Manchester (GB); Mohammed Nawaz, Manchester (GB); Zoonia Mehmood, Manchester (GB)

(73) Assignee: Fujifilm Imaging Colorants Limited, Manchester (GB)

( * ) Notice: Subject to any disclaimer, the term of this patent is extended or adjusted under 35 U.S.C. 154(b) by 644 days.

(21) Appl. No.: 12/665,996

(22) PCT Filed: Jun. 20, 2008

(86) PCT No.: PCT/GB2008/002105

§ 371 (c)(1),
(2), (4) Date: Dec. 22, 2009

(87) PCT Pub. No.: WO2009/001044

PCT Pub. Date: Dec. 31, 2008

(65) Prior Publication Data

US 2010/0190102 A1 Jul. 29, 2010

(30) Foreign Application Priority Data

Jun. 28, 2007 (GB) ..... 0712581.8
Jun. 28, 2007 (GB) ..... 0712582.6

(51) Int. Cl.
*G03G 5/00* (2006.01)
*G03G 9/00* (2006.01)

(52) U.S. Cl.
USPC ..... 430/137.1; 430/137.14

(58) Field of Classification Search
USPC ..... 430/137.1, 137.14
See application file for complete search history.

(56) References Cited

U.S. PATENT DOCUMENTS

| | | | | |
|---|---|---|---|---|
| 4,983,488 | A | 1/1991 | Tan et al. | 430/137 |
| 4,996,127 | A | 2/1991 | Hasegawa et al. | 430/109 |
| 5,066,560 | A | 11/1991 | Tan et al. | 430/137 |
| 5,143,809 | A | 9/1992 | Kaneko et al. | 430/105 |
| 5,290,654 | A | 3/1994 | Sacripante et al. | 430/137 |
| 5,348,832 | A | 9/1994 | Sacripante et al. | 430/137 |
| 5,356,989 | A | 10/1994 | Tachika et al. | 524/608 |
| 5,418,108 | A | 5/1995 | Kmiecik-Lawrynowicz et al. | 430/137 |
| 5,449,707 | A | 9/1995 | Higashiura et al. | 523/501 |
| 5,510,417 | A | 4/1996 | Tachika et al. | 524/608 |
| 5,593,807 | A | 1/1997 | Sacripante et al. | 430/137 |
| 5,648,193 | A | 7/1997 | Patel et al. | 430/137 |
| 6,203,957 | B1 | 3/2001 | Nomura et al. | 430/110 |
| 6,531,256 | B1 * | 3/2003 | Bedells et al. | 430/137.14 |
| 6,756,171 | B2 | 6/2004 | Roh et al. | 430/109.4 |
| 2006/0008723 | A1 | 1/2006 | Fujikawa et al. | 430/108.6 |
| 2006/0051693 | A1 | 3/2006 | Sata et al. | 430/109.4 |
| 2006/0063086 | A1 | 3/2006 | Sacripante et al. | 430/109.4 |
| 2006/0222992 | A1 * | 10/2006 | Kamoto | 430/109.4 |
| 2007/0020550 | A1 | 1/2007 | Kamoto | 430/109.4 |
| 2007/0054210 | A1 | 3/2007 | Ohki et al. | 430/108.21 |
| 2007/0128533 | A1 | 6/2007 | Sata et al. | 430/110.3 |
| 2007/0184378 | A1 | 8/2007 | Miura et al. | 430/114 |
| 2009/0029282 | A1 | 1/2009 | Bertelsen et al. | |

FOREIGN PATENT DOCUMENTS

| | | |
|---|---|---|
| EP | 0 928 995 A2 | 7/1999 |
| EP | 1 316 578 A1 | 6/2003 |
| EP | 1 918 781 A1 | 5/2008 |
| JP | 2004-37610 | 2/2004 |
| JP | 2004-37620 | 2/2004 |
| JP | 2007-108781 | 4/2007 |
| WO | WO 98/50828 | 11/1998 |
| WO | WO 2007/013745 | 2/2007 |

* cited by examiner

*Primary Examiner* — Thorl Chea
(74) *Attorney, Agent, or Firm* — Morgan, Lewis & Bockius LLP

(57) ABSTRACT

A process for preparing a toner comprising a binder resin and a colorant, wherein the binder resin comprises a polyester resin having an acid value (AV) greater than 5 mg KOH/g, the process comprising: providing an aqueous dispersion of self-dispersed polyester resin particles and associating the polyester resin particles by means of a change in the pH of the dispersion.

15 Claims, No Drawings

TONER COMPRISING POLYESTER, PROCESS FOR MAKING THE TONER AND USES THEREOF

This is a 371 filing based on PCT/GB2008/002105 filed Jun. 20, 2008 and claiming priority from Great Britain Application No. 0712582.6, filed Jun. 28, 2007 and Great Britain Application No. 0712581.8, filed Jun. 28, 2007.

The present invention relates to toners comprising polyester resin suitable for using in electrophotography, to processes for preparing said toners and to the uses of said toners in electrophotography.

Electrophotography encompasses image forming technologies such as, for example, photocopying and laser printing. In these technologies a latent, electrostatic image is produced by forming an electrostatic charge on the surface of a photoconductive component (e.g. a drum) and partially or fully discharging the electrostatic charge on parts of the surface of the photoconductive component by exposing those parts to light. The exposure may be from light reflected from an illuminated image (photocopying) or from a laser which scans the photoconductive component, usually under instruction from a computer (laser printing). Once a latent image has been produced in charge it is developed, using a toner, to form a visible toner image on the photoconductive component which can then be transferred onto a suitable substrate (e.g. paper) so that a hard copy of the image is obtained after fixing the toner to the substrate. During printing, friction between particles of toner, with their carrier and/or with parts of the electrophotographic apparatus cause the toner particles to obtain an electrostatic charge (tribocharge) which enables them to develop the latent, electrostatic image. The toner may be employed without a magnetic carrier as so-called "one-component" developer or the toner may be employed with a magnetic carrier as so-called "two component" developer.

Toner comprises toner particles typically of average particle size 1-50 μm but more usually 2-15 μm. The toner particles typically comprise a binder resin, a colorant and optionally other components such as, for example, wax, lubricant and/or charge control agent to improve the properties of the toner. The resin acts to fix the toner to the substrate, usually by fusion of the resin onto the substrate by heating. The colorant, which is usually a pigment, imparts the required colour to the toner. Toners typically also comprise one or more surface additives mixed with the toner particles to modify properties including flowability and chargeability.

Preferably, a toner is capable of forming an image with high resolution and high image density, with little or no significant print defects such as fogging, ghosting and spotting. Furthermore, there are many demanding performance requirements of a toner. For instance, a toner desirably possesses as many of the following characteristics as possible: fixability to a substrate at low temperatures (e.g. by means of heated fusion rollers); releasability from fusion rollers over a wide range of fusion temperatures and/or speeds and/or over a wide range of toner print densities; good storage stability; good print transparency; good toner tribocharging characteristics but with little or no background development of the photoconductor; little or no filming of a metering blade and/or development roller (for a mono-component device) or the carrier bead (for a dual-component device), or of the photoconductor; high transfer efficiency from the photoconductor to the substrate or intermediate transfer belt or roller and from the transfer belt or roller (where used) to the substrate; efficient cleaning of any residual toner remaining after image transfer where a mechanical cleaning device is used.

To form a permanent image on the substrate, it is preferred to fuse or fix the toner particles to the substrate. This may be achieved by radiant heating but is commonly achieved by passing the un-fused toner image between two rollers, with at least one of the rollers heated. It is desirable that the toner does not adhere to the fuser rollers during the fixation process. Common failure modes include paper wrapping (where the paper follows the path of the roller) and offset (where the toner image is transferred to the fuser roller, and then back to a different part of the paper, or to another paper sheet). One solution to these problems is to apply a release fluid, e.g. a silicone oil, to the fuser rollers. However, another solution is to include a release agent (e.g. wax) in the toner to improve the release properties in so-called "oil-less" fusion.

The requirements for achieving an oil-less fusion colour system are severe. It is desirable to achieve a reasonably low fusion temperature, with a wide release temperature window, even at high print densities. The prints preferably show good transparency with controllable gloss. The toner preferably does not show excessive blocking under normal storage conditions, and preferably does not lead to excessive filming of the photoconductive component or metering blade. The release properties of the toner can be affected by the type and/or molecular weight distribution of the resin component (s) of the toner and the optional inclusion of a release agent.

Therefore, obtaining a suitable toner for an image forming system and a process for making it requires careful selection of many possible components and parameters.

Toners can be conventionally produced by melt kneading of a pigment, resin and other toner ingredients, followed by milling or pulverisation to produce toner sized particles. Classification is then needed to generate an acceptably narrow particle size distribution of the toner particles.

More recently, attention has been focussed on chemical routes to toners, where a suitable particle size is not attained by a milling process, which thereby may avoid or reduce the need for a classification step. By avoiding or reducing the classification step, less material is wasted and higher yields of toner can be attained, especially as the target particle size is reduced. Lower particle size toners are of considerable interest for a number of reasons, including better print resolution, lower pile height, greater yield from a toner cartridge, faster or lower temperature fusing, and lower paper curl.

Several chemical routes to toners have been exemplified in the prior art. These include suspension polymerisation, solution-dispersion processes and so-called aggregation processes. Aggregation processes may provide good control over toner size and shape amongst other features and allow for efficient incorporation of different components in the toner. Several different types of aggregation processes are known, for example, as described in U.S. Pat. No. 4,996,127, U.S. Pat. No. 5,418,108, U.S. Pat. No. 5,066,560 and U.S. Pat. No. 4,983,488, and WO 98/50828. Typically in aggregation processes, dispersed resin particles (and preferably colorant particles and optionally particles of other ingredients such as a release agent) are associated to form larger, aggregate particles, which are useful as toner particles, optionally after further treatment such as heat treatment to fuse and/or shape the aggregate particles.

However, it is still desirable to provide further toners and processes for making toners in which as many as possible of the above mentioned desirable properties of a toner are improved.

The present invention, which is described in further detail below, provides a toner and a process for its manufacture in which the binder resin comprises a polyester resin.

In one aspect, the present invention provides a process for preparing a toner comprising a binder resin and a colorant, wherein the binder resin comprises a polyester resin having an acid value (AV) of greater than 5 mg KOH/g, the process comprising: providing an aqueous dispersion of self-dispersed polyester resin particles and then associating the polyester resin particles.

The polyester resin particles may be colored, i.e. the polyester resin particles may contain the colorant, such as one or more pigments or dyes. In such embodiments, the polyester resin particles may be associated without a need for separate colorant particles.

Preferably though, the aqueous dispersion further comprises colorant particles. More preferably, the colorant particles are stabilised by an ionic surfactant in the aqueous dispersion. In such embodiments, the associating step of the process comprises associating the polyester resin particles and the colorant particles.

In preferred embodiments of the present invention, the aqueous dispersion is an aqueous dispersion of colorant particles and polyester resin particles and is prepared by a process comprising the steps of:

(a) providing a dispersion of self-dispersed polyester resin particles, which dispersion is preferably aqueous, wherein the polyester resin particles have an acid value of greater than 5 mg KOH/g;
(b) providing a colorant dispersion of colorant particles stabilised by an ionic surfactant, which dispersion is preferably aqueous; and
(c) mixing the dispersion of polyester resin particles and the colorant dispersion.

In embodiments, the process of the invention may comprise, prior to mixing step (c), one or more further steps, such as, for example, providing a dispersion of non-polyester resin particles and/or a wax dispersion of wax particles, which dispersion(s) is/are then mixed with the other dispersions from steps (a) and (b) in step (c). Such dispersions are preferably aqueous. In such embodiments, after mixing step (c), the non-polyester resin particles and/or wax particles are associated with the colorant and polyester resin particles. In further embodiments, the process may comprise mixing a charge control agent (CCA) with the dispersions in step (c).

In preferred embodiments of the present invention, the dispersion of polyester resin particles is obtained by a polyester dispersion process which includes the steps of: mixing a polyester resin having an acid value (AV) greater than 5 mg KOH/g, an organic solvent, water and optionally a base; and removing the organic solvent to form an aqueous dispersion of self-dispersed polyester resin particles. In more preferred embodiments of the present invention, the dispersion of polyester resin particles is obtained by a polyester dispersion process which includes the steps of: providing (e.g. dissolving) a polyester resin having an acid value (AV) greater than 5 mg KOH/g in an organic solvent to form an organic phase; preparing an aqueous phase comprising water; mixing the organic phase and aqueous phase; and removing the organic solvent to form an aqueous dispersion of self-dispersed polyester resin particles.

In another aspect, the present invention provides a toner obtainable by the process of the present invention.

In still another aspect, the present invention provides a toner comprising a binder resin and a colorant, wherein the binder resin comprises a polyester resin having an acid value of greater than 5 mg KOH/g and the toner is made by a process comprising associating self-dispersed polyester resin particles in a dispersion. The toner is preferably made by a process comprising associating self-dispersed polyester resin particles and colorant particles in a dispersion.

In a still further aspect, the present invention provides the use of a toner according to the present invention in electrophotography.

In a yet still further aspect, the present invention provides an image forming method comprising the steps of: forming an electrostatic image on a photoconductive member; developing the electrostatic image with a toner to form a toner image; transferring the toner image onto a substrate, optionally via one or more intermediate transfer members; and fixing the toner image onto the substrate; wherein the toner is a toner according to the present invention.

In an additional aspect, the present invention provides a toner cartridge having at least one chamber for containing a toner, wherein the chamber contains a toner, which is a toner according to the present invention.

In another aspect of the present invention there is provided a two component developer comprising a mixture of toner particles obtainable by a process according to the present invention and magnetic carrier particles.

In another aspect of the present invention there is provided a method of preparing a two component developer comprising preparing a toner by a process according to the present invention, and then mixing said toner with magnetic carrier particles.

It can be seen that the processes of the present invention are chemical routes to the manufacture of a toner and, in particular, are aggregation processes.

Advantageously, the processes according to the present invention have been found to provide manufacturing routes to toner which may enable: good control over the average particle size and the particle size distribution of the toner; good control over the toner shape (in particular, a shape may be provided, as desired, from substantially spherical to substantially irregular); and/or efficient incorporation of ingredients into the toner. The processes may be conducted without excessively high temperatures or other highly energy consuming conditions. Moreover, toners produced by the processes of the present invention may exhibit: a reasonably low fixation temperature, with a wide release temperature window; good resistance to offset; good transparency in prints; controllable gloss in prints; good resistance to blocking under normal storage conditions, and/or resistance to filming of the photoconducting component or a metering blade.

The toners of the present invention comprising polyester may be suitable for use in electrophotographic apparatus which employ a radiant heat fusion system or a fusion system using a heated roller. Radiant fusion is a fusion (i.e. fixation) system in which infra red lamps are used to soften and/or melt the toner, rather than heated rollers, to fix the toner to the substrate. The toners of the present invention may also be suitable for use as part of a two component developer comprising the toner and a magnetic carrier. By using the polyester resin as described herein in the binder resin, low temperature fusion may be attained with the toner, without using resins with excessively low glass transition temperatures that could give rise to problems in storage stability or filming. The toner of the invention may show good adhesion properties to substrates and good gloss properties. Polyester resins tend to show good pigment wetting properties and are more resistant to vinyl offset than styrene-acrylic resins (vinyl offset is a phenomenon where a printed image may transfer from paper to a plastic sleeve or cover used as a document holder). In addition, the charging properties of polyester-based toners may be advantageous, especially charging rates and stability under activation conditions (e.g. with carrier).

The toner may comprise a release agent (e.g. wax) and/or another (i.e. non-polyester) resin component in the binder resin. Accordingly, the process of the present invention may comprise associating further particles present in the aqueous dispersion with the polyester resin particles and optional colorant particles. The further particles may comprise wax particles and/or other (i.e. non-polyester) resin particles. The aqueous medium in which the polyester resin particles, optional colorant particles and optionally further particles are associated may also contain other toner ingredients such as a charge control agent (CCA) as hereinafter described.

The term aqueous dispersion herein means a dispersion in which the liquid medium of the dispersion comprises water as a major component (which includes the preferred case where water is the sole component of the liquid medium) and organic solvent as a minor component (which includes the preferred case where organic solvent is absent). Preferably, the aqueous dispersion is substantially free of organic solvent.

The particles in the aqueous dispersion may be caused to associate by any suitable method known in the art.

In one type of embodiment for instance, the association may be caused by heating and stirring the aqueous dispersion of particles. Such a process is described, for example, in U.S. Pat. No. 4,996,127.

In preferred embodiments, however, the association is caused by the addition of an association agent.

In embodiments, the association agent may comprise an inorganic salt, in which case the associating method is referred to as "salting-out". Known salting-out processes for associating particles include those described, for example, in U.S. Pat. No. 4,983,488. In salting-out processes for associating the particles, the inorganic salt may comprise an alkali metal salt (e.g. lithium, sodium or potassium chloride and the like), an alkaline earth metal salt (e.g. magnesium or calcium chloride and the like), or a Group HO metal salt (e.g. aluminium chloride and the like).

In other embodiments, the association agent may comprise an organic coagulant, such as an ionic surfactant, of opposite polarity to the acid groups of the polyester resin and any ionic surfactant stabilising colorant and further particles in the aqueous dispersion. Such processes using "counter-ionic" surfactants are described, for example, in U.S. Pat. No. 5,418,108. In a variation of this mechanism, the colorant particles may be stabilised in the colorant dispersion by an ionic surfactant of opposite polarity (charge sign) to the acid groups of the self-dispersed polyester resin particles such that, when the colorant and polyester resin dispersions are mixed, association of the particles may be caused by mutual attraction of the ionic charges.

In most preferred embodiments, the association agent comprises an acid or base, preferably an acid. Such a process for associating the particles in the aqueous dispersion is referred to hereinafter as a "pH switch" process.

In the most preferred associating process wherein the association is caused by a pH switch, e.g. by effecting a change in the pH of the dispersion, preferably from a basic pH to an acidic pH, the association agent is preferably an acid, designed to change the pH of the dispersion. In these embodiments, the association is caused by changing the pH (of the dispersion) to convert the neutralised acid groups of the polyester resin particles and any ionic surfactant which stabilises colorant particles and any further particles from an ionic state to a non-ionic state. In this case, the acid groups on the polyester resin and ionic surfactant in the aqueous dispersion are reversibly ionisable or de-ionisable, i.e. contain a group which can be converted from an ionic to a non-ionic form and vice versa by adjustment of pH (a preferred such group is a carboxy group). The ionic form helps stabilise the particles in the dispersion, whereas the non-ionic form is less-stabilising for the particles so that the particles can be made to associate.

In a particularly preferred example, the neutralised acid groups on the polyester resin and ionic surfactant may comprise a carboxylate group, and the aqueous dispersion may be provided at neutral to high pH (e.g. 7-10, preferably 7-9) with association then being effected by addition of an acid, which decreases the pH (i.e. below neutral and preferably to a pH below 4) and converts the neutralised acid groups on the polyester resin and the ionic surfactant from their more dispersion stabilising ionic carboxylate form to their less-stabilising non-ionic carboxylic acid form.

The pH switch processes allow a very efficient use of surfactant and have the ability to keep overall surfactant levels very low (e.g. compared to "counter-ionic" association processes referred to above). This is advantageous since residual surfactant in the final toner can be problematic, especially in affecting the charging properties of the toner, particularly at high humidity. In addition, such processes avoid the need for large quantities of salt, as required, for example, in the "salting-out" association processes, which would need to be washed out. In the pH switch form of the process, the individual components of binder resin, colorant and any other optional ingredients, can be particularly well mixed prior to inducing association, which, in turn, may lead to improved homogeneity of distribution of the components in the final toner and consequently improved toner properties. Also, the pH switch process may be performed in the absence of organic solvents, that is to say in liquid media which contain water but no organic solvents.

Stirring to achieve mixing of the particles is preferably performed during the association step.

The association step is preferably carried out below the Tg of the binder resin.

The processes of the present invention preferably comprise a further step of heating and/or stirring (preferably both) the associated particles, preferably at a temperature below the Tg of the binder resin. Preferably such heating and/or stirring of the associated particles causes loose (un-fused) aggregates to form and/or grow to the desired size. This step of heating and/or stirring the associated particles is referred to herein as the growth step. The growth step is preferably performed at a temperature not lower than about 25° C. below the Tg of the binder resin. The growth step is preferably performed at a temperature in a range which is from 5 to 25° C. below the Tg of the binder resin. The aggregates are composite particles comprising the polyester resin particles, optional colorant particles and optional further particles as described above (e.g. wax particles and/or non-polyester resin particles). Preferably, the aggregates are of particle size from 1 to 20 μm, more preferably from 2 to 20 μm. Once the desired aggregate particle size is established, the aggregates may be stabilised against further growth. This may be achieved, for example, by the addition of further surfactant, and/or by a change in pH to convert the ionic surfactant back to its ionic form (e.g. by a change in pH back to high, i.e. around or above neutral (e.g. 7-8), for stabilisation where acid was used to associate the particles). Stabilisation against further growth by a change in pH is especially preferable where a pH switch process was employed for the association. Stabilisation against further growth by a change in pH preferably converts the ionisation state of the acid groups on the polyester resin particles and the ionic surfactant from their less stabilising non-ionic form (e.g. carboxylic acid form) back to their more dispersion stabilising ionic form (e.g. carboxylate form). In preferred embodiments, both addition of further (preferably ionic) surfactant and a change in pH are employed.

Where possible it is preferred to use a pH change to stabilise the associated un-fused particles and to add as little as possible (preferably no) further surfactant.

The aggregates may be recovered by, for example, methods known in the art and may be usable as toner particles as they are or, preferably, the aggregates may be subjected to further treatment as described below to improve their suitability as toner particles.

After the association and optional growth step of heating and/or stirring to establish the desired aggregate particle size, the temperature may then be raised above the Tg of the binder resin in a fusion step. Especially when the binder resin comprises polyester as a major component of the binder resin (including the case where the binder resin comprises only polyester resin, i.e. no non-polyester resin), the fusion is preferably performed at a temperature in the range 15 to 40° C. above the Tg of the binder resin, more preferably at a temperature in the range 20 to 35° C. above the Tg of the binder resin. Typically, in view of preferred Tg values for the polyester resin, the fusion temperature may be in the range 80 to 100° C. When a non-polyester resin is additionally present, especially a vinyl resin, the fusion temperature may be higher than aforementioned. For instance the fusion temperature may lie in the range above 80° C. or above 100° C., e.g. from 80 to 140° C. or from 100 to 140° C. The fusion step brings about fusion (i.e. coalescence) of the aggregates. Thus, the toner particles so formed comprise aggregates which have been internally fused. The fusion may occur by fusion of the particles within each aggregate and/or between aggregates to form toner particles. The aggregates and/or toner particles typically have a volume average particle size from 2 to 20 μm, more preferably 4 to 10 μm, still more preferably 5 to 9 μm. During this fusion step of heating above the Tg the shape of the toner may be controlled through selection of the temperature and the heating time.

In certain embodiments, the fusion of the aggregates may be effected at the same time as formation of the aggregates, wherein the heating and/or stirring to grow the aggregates is conducted above the Tg of the resin, although it is more preferred to use the method described above of performing the fusion step after formation of the aggregates.

The toner particles or aggregates are preferably recovered, e.g. by filtration, for subsequent use as an electrophotographic toner. After fusion, the dispersion of toner particles is preferably cooled and then the toner particles recovered. Methods of recovery include filtration, such as filtration by a filter press. The recovered toner may then optionally be washed (e.g. to remove at least some surfactant) and/or optionally be dried using methods known in the art. The washing step, for example, may comprise washing with water, or dilute acid or base. Drying, for example, may comprise drying assisted by heat and/or reduced pressure (vacuum).

The toner particles, especially the recovered and dried toner particles, may be blended with one or more surface additives as known in the art and/or as described in more detail below.

The dispersed polyester resin particles are self-dispersed, i.e. they do not require surfactant to disperse them in an aqueous medium. Of course, it is possible that a surfactant may be present with the polyester resin particles. Preferably, however the polyester resin particles (whilst separate from any other components used in the process for preparing the toner) do not comprise any surfactant and they are not stabilised by any surfactant. The polyester resin particles have acid groups which when neutralised with a base enable the particles to disperse in an aqueous medium. However, any surfactant present in the dispersion, e.g. to disperse colorant particles and/or any further particles, may additionally aid dispersion of the resin particles.

The polyester resin may be dispersed in the aqueous medium by heating to form dispersed polyester resin particles.

Preferably, the polyester resin is dispersed in the aqueous medium by mixing a polyester resin having an acid value (AV) greater than 5 mg KOH/g, an organic solvent, water and optionally a base; and removing the organic solvent to form an aqueous dispersion of self-dispersed polyester resin particles. In one embodiment the dispersion of the polyester resin particles is prepared in the absence of any surfactant, more particularly in the absence of any ionic surfactant. In this way the polyester resin particles are exclusively self-dispersed (only self-dispersed).

Preferably, the polyester resin is dispersed in the aqueous medium by providing (e.g. dissolving) the polyester resin in an organic solvent to form an organic phase; preparing an aqueous phase comprising water; mixing the organic phase and the aqueous phase; and removing the organic solvent to leave an aqueous dispersion of polyester resin particles. Mixing of the organic phase in the aqueous phase may be performed by any suitable method of mixing dispersions. The mixing may be performed using a low shear energy step (e.g. using a low shear stirring means) and/or a high shear energy step (e.g. using a rotor-stator type mixer). Preferably the mixing is performed by a process which comprises at least a high shear energy step. In the case of using a water-immiscible organic solvent, the mixing of the organic phase and the aqueous phase may result in dispersed droplets of the organic phase in the aqueous phase prior to the solvent removal.

The organic solvent may be water-immiscible or water-miscible. Any suitable known water-miscible organic solvent may be used, e.g. alcohols (e.g. methanol, ethanol, propanol, isopropanol (IPA), butanol etc.), ketones (e.g. acetone, methyl ethyl ketone (MEK) etc.), glycols (e.g. ethylene glycol, propylene glycol etc.), alkyl ethers of ethylene glycol (e.g. methyl cellosolve™, ethyl cellosolve™, butyl cellosolve™ etc.), alkyl ethers of diethylene glycol (e.g. ethyl carbitol™, butyl carbitol™ etc.), alkyl ethers of propylene glycol, ethers (dioxane, tetrahydrofuran etc.) and the like. Any suitable known water-immiscible organic solvent may be used for dissolving the polyester resin. Suitable water-immiscible organic solvents include: alkyl acetates (e.g. ethyl acetate), hydrocarbons (e.g. hexane, heptane, cyclohexane, toluene, xylene etc.), halogenated hydrocarbons (e.g. methylene chloride, monochlorobenzene, dichlorobenzene etc.), and other known water-immiscible organic solvents. Two or more solvents (i.e. co-solvents) may be used.

The amount of residual organic solvent present in the aqueous dispersion is preferably less than 2000 ppm (e.g. 1750 ppm), more preferably less than 1500 ppm (e.g. 1250 ppm), still more preferably less than 1000 ppm (e.g. 750 ppm), even more preferably less than 500 ppm (e.g. 400 ppm) and most preferably less than 300 ppm (e.g. 275 ppm, 150 ppm or 50 ppm). All parts per million (ppm) are by weight. The amount of residual solvent may be measured by methods known in the art, preferably by headspace Gas Chromatography-Mass Spectrometry (GC-MS).

A base is employed to neutralise the acid groups of the polyester resin in order to enable the polyester resin to be dispersed as particles in the aqueous medium. The base may be any suitable base for neutralising acid groups, for example, metal salts (including sodium hydroxide and potassium hydroxide), ammonium hydroxide and the like and amines (e.g. organic amines). The base may be provided in either of the organic phase or aqueous phase (or both), or may be added after the organic phase and aqueous phase have been mixed provided that further mixing is performed after the base has been added. Preferably, the base is provided in the aqueous phase.

The acid value (AV) of the resin is the number of milligrams (mg) of potassium hydroxide (KOH) required to neutralise one gram (g) of resin. The AV of the polyester resin (and therefore of the polyester resin particles) is greater than 5 mg KOH/g. Preferably, the AV is not less than 8 mg KOH/g, more preferably not less than 10 mg KOH/g and most preferably not fess than 12 mg KOH/g (e.g. not less than 15). Also preferably, the AV is not more than 50, more preferably not more than 40 and most preferably not more than 35 mg KOH/g. If the AV is too low, it affects the stability of aggregates formed as herein described during a fusion step. Furthermore if the AV is too low, the dispersion of polyester resin particles may not be adequately formed (stabilised). if the AV is too high, the toner may be too sensitive to humidity, which can affect the tribocharge of the toner.

In embodiments, a preferred range of the AV of the polyester resin is from 5 to 50 mg KOH/g, more preferably from 8 to 50 mg KOH/g and still more preferably from 10 to 50 mg KOH/g. Even more preferably, the range of the AV is from 10 to 40, yet even more preferably from 12 to 40 and most preferably from 12 to 35 mg KOH/g.

For the avoidance of doubt, the AV specified herein for any particles is the AV of the particles alone and does not include any contribution from any surfactant that may be associated with the particles.

The acid groups of the polyester resin (and hence of the polyester resin particles) giving rise to the described AV are preferably present at the ends of the polyester chains, i.e. the polyester resin has acid end-groups, preferably carboxylic acid end-groups as described in more detail below.

In embodiments where more than one kind of polyester resin is used in the process of the present invention it is sufficient that at least one of the polyesters has the required AV. More generally, it is preferred that when more than one resin is used in the process of the present invention the overall AV of all the resins present is as described above for the polyester resin.

In embodiments, preferably the acid groups of the polyester resin, which are preferably carboxylic acid groups as described below, are neutralised (using a base) prior to association of the particles so that the acid groups are present, prior to association, in salt form (e.g. $—COO^-M^+$, where $M^+$ is an alkali metal ion (e.g. $Li^+$, $Na^+$, $K^+$) or ammonium ion). Neutralisation may occur only at the polyester resin particle surface. The base for neutralising the acid groups prior to association may be added at any convenient stage prior to association. For instance, the base is preferably included in the aqueous phase with which the organic phase is mixed. The addition of base may also serve to ensure that any acid (e.g. carboxy) functional ionic surfactant present is in its dispersion stabilising ionic (e.g. carboxylate) form. Suitable bases include, for example, metal salts (including sodium hydroxide and potassium hydroxide), ammonium hydroxide and the like and amines (e.g. organic amines). Accordingly, the pH of the aqueous dispersion containing the polyester particles, prior to the association step, is preferably in the range 6 to 10, more preferably 7 to 10, most preferably 7 to 9.

The polyester resin is preferably carboxy functional. By carboxy functional it is meant that the acid groups in the polyester resin are carboxylic acid groups. Preferably, the carboxylic acid groups are present in the neutralised carboxylate salt form (e.g. lithium, sodium or potassium salt form, especially sodium salt form) when the polyester resin particles are stabilised in the dispersion. This may be the case for instance when the dispersion of the polyester resin particles is at or above neutral pH.

The preferred carboxylic acid groups on the polyester resin are reversibly ionisable by appropriate changes to the pH and therefore may assist in the particular association mechanism described above which operates by a pH switch. For instance, the carboxylic acid groups may be present in a neutralised ionic carboxylate form when the polyester resin particles are stabilised in dispersion but may be converted in the association step by changing the pH through addition of acid to the non-ionic carboxylic acid form, thereby causing the particles to become unstable and so associate.

In view of the preferences herein, in particularly preferred embodiments, the polyester resin particles are carboxy functional polyester resin particles and are stabilised in the aqueous dispersion by their neutralised carboxy groups. Preferably, in such embodiments, the colorant particles are stabilised in the aqueous dispersion by a carboxy functional ionic surfactant.

Preferably, the polyesters of the present invention do not contain any sulphonic acid (or sulphonate forms thereof) groups (i.e. $—SO_3H$ groups and sulphonate salt forms thereof, e.g. $—SO_3Na$). Such groups, which are highly polar, may lead to the toner charging being excessively sensitive to humidity. In the present invention, dispersion of the polyester resin can be achieved without such groups and the polyester resin particles of the dispersion can be effectively associated. Most preferably, the acid groups in the polyester resin consist essentially of carboxylic acid groups.

The mean size of the polyester resin particles is preferably at least 30 nm, more preferably at least 40 nm and most preferably at least 45 nm. The mean size of the polyester resin particles is preferably not greater than 200 nm, more preferably not greater than 150 nm, still more preferably not greater than 140 nm. Accordingly, preferred ranges of the mean size of the polyester resin particles are (in order of increasing preference): from 30 to 200 nm (especially 30 to 150 nm), from 40 to 200 nm (especially 40 to 150 nm), from 45 to 200 nm (especially 45 to 150 nm). In each case, still more preferably, the upper limit of the range is 140 nm. The mean size of the polyester resin particles specified herein is calculated by taking the average size of 100 to 500, more preferably of 100 to 300 particles measured by Transmission Electron Microscopy (TEM). If the particle size of the polyester resin particles is too small then the viscosity of the liquid medium after associating the particles may become too high leading to processing problems in connection with agitation of the liquid. Furthermore, if the particle size of the polyester resin particles is too small, the particle size distribution of the toner may become too large.

The glass transition temperature (Tg) of the polyester resin is preferably in the range 45-75° C., more preferably in the range 50-70° C., still more preferably in the range 55-65° C. and most preferably in the range 57-65° C. If the Tg is too low, the storage stability of the toner may be reduced. If the Tg is too high, the melt viscosity of the resin may be raised, which will increase the fixation temperature and the temperature required to achieve adequate transparency. The Tg may be established by any suitable means, but a preferred method is Differential Scanning Calorimetry (DSC).

The polyester resin may comprise a single polyester resin or a blend of two or more polyester resins. Where a blend of two or more polyester resins is used the resins may be of the same or preferably different molecular weight. In cases where the polyester resin comprises a blend of two or more polyester resins, the polyester resin particles in dispersion prior to association may comprise separate particles of each individual polyester resin and/or the polyester resin particles may comprise particles comprising a blend of polyester resins.

The polyester resin particles may be colored, i.e. contain the colorant. Accordingly, the polyester resin particles may be pigmented or dyed, i.e. contain pigment or contain dye. In the case of using colored polyester resin particles, an aqueous dispersion of the particles may be produced by a solution dispersion process in the following way. The polyester resin is dissolved in an organic solvent. In one embodiment the organic solvent used is immiscible with water, dissolve the resin and/or be removable by distillation relatively easily. Suitable organic solvents comprise xylene, ethyl acetate and/or methylene chloride. In this solution is provided a colorant, either a pigment or a dye. If a dye is used this is simply dissolved in the polyester resin solution to produce a colored liquid solution. If a pigment is used it may be provided preferably with one or more suitable pigment dispersants (which may be ionic or non-ionic). The colored polyester resin solution is then dispersed in water with a surfactant and the organic solvent removed by distillation to leave an aqueous dispersion of colored (pigmented or dyed) polyester resin particles containing the colorant dissolved or dispersed within the polyester resin.

Preferably, however, the polyester resin particles are not colored and instead colorant particles are dispersed and then associated with the polyester resin particles.

The composition of the polyester resin is not limited and suitable compositions may include any known polyester compositions, especially those for use in toners.

Suitable polyesters are typically made from at least one (preferably one or two) polyfunctional (e.g. difunctional, trifunctional and higher polyfunctional) acid, ester or anhydride and at least one (preferably one or two) polyfunctional (e.g. difunctional, trifunctional and higher polyfunctional) alcohol. More specifically, polyesters may be made from at least one polyfunctional carboxylic acid, ester or anhydride and at least one polyfunctional alcohol. Methods and reaction conditions for the preparation of polyester resins are well known in the art. Melt polymerisation and solution polymerisation processes may be used to prepare polyesters. The polyfunctional acid or ester or anhydride component(s) may be employed in an amount which is 45-55% by weight of the total polyester resin and the polyfunctional alcohol component(s) may be employed in an amount which is 45-55% by weight of the total polyester resin. Preferably, the aforementioned components to make the polyester resin are employed in amounts such that acid groups remain in the polyester resin thereby giving rise to the described acid value (AV) and are preferably present at the ends of the polyester chains.

Examples of suitable difunctional acids include: acids such as di-carboxylic acids including: aromatic dicarboxylic acids such as: phthalic acid; isophthalic acid; terephthalic acid; aliphatic di-carboxylic acids such as: unsaturated di-carboxylic acids, including maleic acid, fumaric acid, citraconic acid, itaconic acid, saturated di-carboxylic acids, including malonic acid; succinic acid; glutaric acid; adipic acid; pimelic acid; azelaic acid; sebacic acid; 1,2-cyclohexanedioic acid; 1,3-cyclohexanedioic acid; 1,4-cyclohexanedioic acid; succinic anhydride; glutaric anhydride; substituted (especially alkyl substituted, more especially methyl substituted) forms of the foregoing compounds; and mixtures of two or more of the foregoing compounds. Examples of suitable difunctional esters include esters of the foregoing difunctional acids and anhydrides, especially alkyl esters and more especially methyl esters thereof. Other examples of suitable difunctional anhydrides include anhydrides of the foregoing difunctional acids.

Preferably, the polyester is made from at least one aromatic dicarboxylic acid or ester, especially isophthalic acid and/or terephthalic acid and/or ester thereof.

Examples of suitable trifunctional or higher functional acids, esters or anhydrides include: trimellitic acid, pyromellitic acid and the like and esters and anhydrides thereof.

Examples of suitable difunctional alcohols include: aliphatic diols such as: alkylene glycols including ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, 1,2-hexylene glycol, 1,3-hexylene glycol, 1,4-hexylene glycol, 1,5-hexylene glycol, 1,6-hexylene glycol, heptylene glycols, octylene glycols, decylene glycol, dodecylene glycol; 2,2-dimethyl propane diol; 1,2-cyclohexane diol; cyclohexane diol; 1,4-cyclohexane diol; 1,2-cyclohexane dimethanol, 2-propene-diol; aromatic dials such as bisphenol A derivatives, especially alkoxylated bisphenol A derivatives, including bisphenol A alkoxylated with ethylene oxide and/or propylene oxide, e.g. ethoxylated bisphenol A compounds and propoxylated bisphenol A compounds; substituted (especially alkyl substituted, more especially methyl substituted) forms of the foregoing compounds and mixtures of two or more of the foregoing compounds.

Preferably, the polyester is made from at least one aliphatic diol and optionally at least one aromatic diol. In embodiments, the polyester is made from at least one aliphatic diol and at least one aromatic diol. Preferred aliphatic diols are ethylene glycol, 1,3-propylene glycol and 2,2-dimethyl propane diol. Preferred aromatic diols are bisphenol A derivatives, especially ethoxylated bisphenol A and propoxylated bisphenol A.

Examples of suitable trifunctional or higher functional alcohols include trimethylolpropane, pentaerythritol and sorbitol and the like.

The polyester resin may be linear, branched and/or crosslinked.

Preferably, the polyester is substantially linear. Linear polyesters are typically prepared using the reaction between difunctional acids, esters, or anhydrides and difunctional alcohols.

In view of the above, in embodiments, the polyester may be made from: at least one polyfunctional carboxylic acid or ester which comprises at least one (preferably aromatic) di-carboxylic acid or ester; and at least one polyfunctional alcohol which comprises at least one aliphatic diol.

In other embodiments, the polyester may be made from: at least one polyfunctional carboxylic acid or ester which comprises at least one (preferably aromatic) di-carboxylic acid or ester or anhydride; and at least two polyfunctional alcohols which comprise at least one aliphatic diol and at least one aromatic diol.

In still other embodiments, the polyester may be made from: at least one polyfunctional carboxylic acid or ester which comprises at least one (preferably aromatic) di-carboxylic acid or ester; and at least one polyfunctional alcohol which comprises at least one aromatic diol.

In further embodiments, the polyester may be made from: at least one polyfunctional carboxylic acid or ester which comprises at least one aliphatic di-carboxylic acid or ester or anhydride; and at least one polyfunctional alcohol which comprises at least one aliphatic diol.

In still further embodiments, the polyester may be made from: at least one polyfunctional carboxylic acid or ester which comprises at least one aliphatic di-carboxylic acid or ester or anhydride: and at least one polyfunctional alcohol which comprises at least one aromatic diol.

In the foregoing embodiments: preferred aromatic di-carboxylic acids or esters are selected from isophthalic acid and terephthalic acid: a preferred aliphatic di-carboxylic acid or ester is fumaric acid; preferred aromatic diols are selected from ethoxylated bisphenol A compounds and propoxylated bisphenol A compounds; and preferred aliphatic diols are selected from ethylene glycol, 1,3-propylene glycol and 2,2-dimethyl propane diol.

In any of the embodiments, if desired (e.g. in order to provide branching and/or crosslinking), a tri-functional (or higher functional) acid, ester or anhydride and/or a tri-functional (or higher functional) alcohol may be included in the polyester composition.

Many polyester resin compositions useful for toners and methods for their production are described in the prior art and may be utilised in the present invention, for example as described in U.S. Pat. No. 4,804,622, U.S. Pat. No. 4,863,824 and U.S. Pat. No. 5,503,954, the contents of which are incorporated herein.

In this specification, including in the claims, unless stated otherwise, references to the singular (a, an, the etc.) include references to the plural (two or more). For example, where an ionic surfactant is described for stabilising any particles, more than one ionic surfactant may be used to stabilise said particles.

Suitable ionic surfactants for use in the present invention include known anionic and cationic surfactants. Examples of suitable anionic surfactants are: alkyl benzene sulphonates (e.g. sodium dodecylbenzene sulphonate); alkyl sulphates; alkyl ether sulphates; sulphosuccinates; phosphate esters; carboxy functional surfactants such as: fatty acid carboxylates, including alkyl carboxylates, and alkyl or aryl alkoxylated carboxylates, including, for example, alkyl ethoxylated carboxylates, alkyl propoxylated carboxylates and alkyl ethoxylated/propoxylated carboxylates. Examples of suitable cationic surfactants are: quaternary ammonium salts; benzalkonium chloride; ethoxylated amines.

Preferred ionic surfactants are anionic surfactants. More preferred still are carboxy functional surfactants, i.e. surfactants having a carboxy group. Preferably, the ionic surfactants have one or more carboxy groups and no other anionic group (e.g. no sulfonic acid or phosphonic acid group). Carboxy functional surfactants are reversibly ionisable and therefore are preferred for a process wherein the association is caused by a pH switch as described above. Carboxy functional surfactants include, for example, fatty acid carboxylates (including alkyl carboxylates) and alkyl or aryl alkoxylated carboxylates. Examples of fatty acid carboxylates include salts of lauric acid, myristic acid, palmitic acid, stearic acid, oleic acid and the like. Most preferred still are the alkyl alkoxylated carboxylates, such as, e.g., alkyl ethoxylated carboxylates, alkyl propoxylated carboxylates and alkyl ethoxylated/propoxylated carboxylates. Suitable alkyl alkoxylated carboxylates are commercially available, such as in the Akypo™ range of surfactants from Kao Corporation and the Marlowet™ range of surfactants from Sasol.

Especially preferred carboxy functional ionic surfactants are alkyl alkoxylated carboxylates represented by Formula A below:

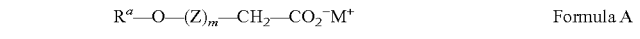

$$R^a—O—(Z)_m—CH_2—CO_2^-M^+ \quad \text{Formula A}$$

wherein:

$R^a$ represents an optionally substituted alkyl group;

Z represents an alkylene oxide group;

m is an integer from 1 to 20; and $M^+$ represents a monovalent cationic counter-ion.

The optionally substituted alkyl group $R^a$ is preferably a $C_{1-20}$ alkyl group, more preferably a $C_{4-18}$ alkyl group, still more preferably a $C_{6-16}$ alkyl group and most preferably a $C_{8-14}$ alkyl group. Preferably the $R^a$ alkyl group is unsubstituted.

Preferably, Z represents an ethylene oxide (EO) or propylene oxide (PO) group. Each Z may be the same alkylene oxide group, e.g. each Z may be EO or each Z may be PO. Alternatively, each Z may independently represent EO or PO, such that EO and PO units may be randomly positioned in the $—(Z)_m—$ chain.

Preferably, m is an integer from 2-16, more preferably from 3-12 and most preferably from 4-10.

Preferably, $M^+$ represents an alkali metal cation or an ammonium cation. More preferably, $M^+$ represents $Li^+$, $Na^+$, $K^4$ or $NH_4^+$ (especially $Na^+$).

In preferred embodiments, the ionic surfactant preferably has a Formula A above wherein: $R^a$ is a $C_{10-14}$alkyl group, more preferably a $C_{12-14}$alkyl group; each Z independently represents an ethylene oxide or propylene oxide group, more preferably an ethylene oxide group; and m is 8 to 12, preferably 8 to 10, especially 10.

One or more non-ionic surfactants may be additionally employed to further help stabilise any of the particles used in the process. Examples of suitable non-ionic surfactants include: alkyl ethoxylates; alkyl propoxylates; alkyl aryl ethoxylates; alkyl aryl propoxylates; and ethylene oxide/propylene oxide copolymers. Suitable commercially available non-ionic surfactants include the Solsperse™ range of surfactants from Noveon.

The ionic surfactant for stabilising the colorant particles and preferably any further particles is preferably a reversibly ionisable ionic surfactant. Preferably, an ionic surfactant of the same polarity as the acid groups of the polyester resin particles is used. More preferably, the same ionic surfactant is used for stabilising the colorant particles and any further particles. By the term reversibly ionisable surfactant is meant that the surfactant may be changed from its ionic state to a non-ionic (i.e. neutral) state and vice versa. The change in ionisation state of the ionic surfactant may be effected, for example, by a change in pH of the liquid medium. Preferred reversibly ionisable ionic surfactants include surfactants which are carboxy functional surfactants, i.e. having carboxylic acid groups, which are reversibly convertible by a pH change between a neutral, protonated acid state and an ionised, anionic carboxylate state. Other preferred reversibly ionisable ionic surfactants include surfactants having amine groups, which are reversibly convertible by a pH change between a neutral, amine state and an ionised, cationic ammonium state. Most preferred reversibly ionisable ionic surfactants are carboxy functional surfactants such as, for example, the alkyl carboxylates; and alkyl alkoxylated carboxylates described above. Preferred carboxylate surfactants are described above and these are reversibly ionisable. By changing the pH of the aqueous dispersion the ionic surfactant may be switched from its dispersion stabilising ionic state to a non-ionic state thereby causing the resin particles in the dispersion to associate.

Accordingly, the dispersion of polyester resin particles is preferably stabilised by neutralised carboxy groups on the resin particles and the colorant dispersion stabilised with a carboxy functional ionic surfactant, which thereby has the same polarity as the neutralised carboxy groups. The carboxy groups of the polyester resin and ionic surfactant are capable of being converted from an ionic to a non-ionic form (and vice versa) by a change in pH, i.e. are reversibly ionisable.

In view of the preferences herein, in an especially preferred embodiment, there is provided a process for preparing a toner comprising a binder resin and a colorant, wherein the binder resin comprises a polyester resin having carboxy groups and an acid value from 10 to 50 mg KOH/g, the process comprising: (i) providing an aqueous dispersion of self-dispersed polyester resin particles having carboxy groups and an acid value from 10 to 50 mg KOH/g wherein the polyester resin particles have a mean size of from 30 to 200 nm; (ii) providing an aqueous colorant dispersion of colorant particles stabilised by a carboxy functional ionic surfactant; (iii) mixing the aqueous dispersion of polyester resin particles and the aqueous colorant dispersion to form an aqueous dispersion of colorant particles and polyester resin particles; (iv) associating the colorant particles and polyester resin particles by decreasing the pH of the dispersion to change the ionisation state of the carboxy groups of the polyester resin and the carboxy functional ionic surfactant from an ionic state to a non-ionic state; (v) heating and/or stirring the associated particles at a temperature below the Tg of the binder resin to cause loose aggregates to form; and (vi) raising the temperature of the dispersion above the Tg of the binder resin to fuse the aggregates to form toner particles.

In view of the preferences herein, in another especially preferred embodiment, there is provided a process for preparing a toner comprising a binder resin and a colorant, wherein the binder resin comprises a polyester resin having carboxy groups and an acid value from 10 to 50 mg KOH/g, the process comprising: (i) providing an aqueous dispersion of self-dispersed polyester resin particles by a polyester dispersion process which includes the steps of: mixing the polyester resin, an organic solvent and water; neutralising the polyester resin; and removing the organic solvent to form an aqueous dispersion of polyester resin particles wherein the polyester resin particles have a mean size of from 30 to 200 nm; (ii) providing an aqueous colorant dispersion of colorant particles stabilised by a carboxy functional ionic surfactant; (iii) mixing the aqueous dispersion of polyester resin particles and the aqueous colorant dispersion to form an aqueous dispersion of colorant particles and polyester resin particles; (iv) associating the colorant particles and polyester resin particles by decreasing the pH of the dispersion to change the ionisation state of the carboxy groups of the polyester resin and the carboxy functional ionic surfactant from an ionic state to a non-ionic state; (v) heating and/or stirring the associated particles at a temperature below the Tg of the binder resin to cause loose aggregates to form; and (vi) raising the temperature of the dispersion above the Tg of the binder resin to fuse the aggregates to form toner particles.

Further preferred features of the present invention are now described.

The toner comprises binder resin and colorant and may comprise wax and/or another (i.e. non-polyester) resin component in the binder resin. Accordingly, the processes of the present invention may comprise associating further particles with the polyester resin particles and optional colorant particles. The further particles may comprise wax particles and/or other (i.e. non-polyester) resin particles. Where present, the further particles preferably comprise at least wax particles. The aqueous medium in which the polyester resin particles, optional colorant particles and optionally further particles are associated may also contain other toner ingredients such as a charge control agent (CCA) as herein described.

In preferred embodiments, in the aqueous dispersion of polyester resin particles and colorant particles, the colorant particles are preferably dispersed with ionic surfactant.

In embodiments, there is provided a colorant dispersion containing colorant particles dispersed therein with an ionic surfactant, in such embodiments, the processes of the present invention comprise mixing the aqueous dispersion of polyester resin particles and the colorant dispersion before associating the polyester resin particles and the colorant particles.

In embodiments where the toner contains wax, in addition to the aqueous dispersion of polyester resin particles, there is provided a colorant dispersion containing colorant particles dispersed therein with an ionic surfactant and there is provided a wax dispersion containing wax particles dispersed therein, which wax particles may be self-dispersed or dispersed with an ionic surfactant. In such embodiments, the processes of the present invention comprise mixing the aqueous dispersion of polyester resin particles, the colorant dispersion and wax dispersion before associating the polyester resin particles, colorant particles and wax particles.

In other embodiments, in addition to the aqueous dispersion of polyester resin particles, optional colorant dispersion and optionally a wax dispersion, there is provided a non-polyester resin dispersion containing non-polyester resin particles dispersed therein preferably with an ionic surfactant. In such embodiments, the processes of the present invention comprise mixing the aqueous dispersion of polyester resin particles, colorant dispersion, optional wax dispersion and dispersion containing non-polyester resin particles before associating the polyester resin particles, colorant particles, non-polyester resin particles and optional wax particles.

The term colorant particles herein means any particles which are colored and accordingly includes particles of colorant as well as particles which contain colorant. For example, colorant particles may include, without limitation, pigment particles, pigmented particles such as pigmented resin particles (i.e. resin particles containing pigment therein), or dyed particles such as dyed resin particles (i.e. resin particles containing dye therein) but pigmented or dyed polyester resin particles are herein classed as the polyester resin particles of the present invention rather than as colorant particles. More preferably, the colorant particles are pigment particles or pigmented particles (hereinafter collectively pigmentary particles). Most preferably, the colorant particles comprise pigment particles. For the avoidance of doubt, in the case where the colorant is contained within polyester resin particles, such colored polyester resin particles are classed herein as polyester resin particles rather than as colorant particles.

The colorant particles are preferably stabilised in the aqueous dispersion by an ionic surfactant.

Preferably, the colorant dispersion is a dispersion in water i.e. is an aqueous dispersion. The colorant dispersion may be prepared by processes known in the art, preferably by milling the colorant with an ionic surfactant in an aqueous medium.

Alternatively, for example in the case of using pigmented or dyed resin particles as colorant particles, an aqueous dispersion of colorant particles may be produced by a solution dispersion process in the following way. A resin (non-polyester) is dissolved in an organic solvent. Preferably the organic solvent used should be immiscible with water, dissolve the resin and/or be removable by distillation relatively easily. Suitable organic solvents comprise xylene, ethyl acetate and/or methylene chloride. To this solution is added a colorant, either a pigment or a dye. If a dye is used this is simply dissolved in the resin solution to produce a colored liquid solution. If a pigment is used it may be added, preferably with one or more suitable pigment dispersants (which may be ionic or non-ionic). The colored resin solution is then dispersed in water with a surfactant and the organic solvent removed by distillation to leave an aqueous dispersion of pigmented or dyed resin particles containing the colorant dissolved or dispersed within the resin.

The colorant dispersion preferably comprises an ionic surfactant, more preferably an ionic surfactant as described above, to stabilise the colorant particles in dispersion. Optionally, a non-ionic surfactant may also be incorporated into the colorant dispersion. Examples of ionic and non-ionic surfactants for the colorant dispersion are as described above.

Preferably, the colorant dispersion is stabilised with an ionic surfactant, which has the same polarity (and more preferably has the same ionic functional group) as the acid groups of the polyester resin and which is capable of being converted from an ionic to a non-ionic form (and vice versa) by a change in pH, i.e. is reversibly ionisable. Also preferably, the colorant dispersion is stabilised with an ionic surfactant, which has the same polarity (and more preferably is the same ionic surfactant) as the ionic surfactant in the optional wax dispersion and the optional non-polyester resin particle dispersion and which is capable of being converted from an ionic to a non-ionic form (and vice versa) by a change in pH, i.e. is reversibly ionisable. Preferred reversibly ionisable ionic surfactants are described above, e.g. carboxy functional ionic surfactants. This is especially applicable in a preferred embodiment of the process wherein the association is caused by a pH switch process as described above. Examples of ionic and optionally non-ionic surfactants for the colorant dispersion are the same as for the optional wax dispersion and optional non-polyester resin particle dispersion and are described herein.

The colorant may be of any colour including black or white. The colorant may comprise a pigment or a dye. Preferably, the colorant comprises a pigment. Any suitable pigment known in the art can be used, including black and magnetic pigments. Chemical classes of pigments include, without limitation for example carbon black, magnetite, copper phthalocyanine, quinacridones, xanthenes, mono- and dis-azo pigments, naphthols etc, Examples include C.I. Pigment Blue 15:3, C.I. Pigment Red 31, 57, 81, 122, 146, 147, 184 or 185; C.I. Pigment Yellow 12, 13, 17, 74, 83, 93, 150, 151, 155, 180 or 185. In full colour printing it is normal to use yellow, magenta, cyan and black toners. However, it is possible to make specific toners for spot colour or custom colour applications.

The colorant is preferably present in an amount from 1-15% by weight based on the total weight of the binder resin, colorant, optional wax, optional CCA and surfactant (termed herein the total weight of solids), more preferably from 1.5-10% by weight, most preferably from 2-8% by weight. The term binder resin herein means all of the resin components present (i.e. the polyester resin and, where present, non-polyester resin). These ranges are most applicable for organic, non-magnetic pigments. If, for example, magnetite was used as a magnetic filler/pigment, the level would typically be higher than these ranges.

Preferably, in one embodiment of the process, the colorant dispersion is prepared by milling the colorant with the ionic surfactant, and optionally a non-ionic surfactant, until the particle size is suitably reduced.

Preferably, the volume average size of the colorant particles, as measured by laser diffraction, is less than 500 nm, more preferably less than 300 nm, still more preferably less than 200 nm and most preferably less than 100 nm. It is preferably more than 20 nm. A suitable measuring device for this purpose is the Coulter™ LS230 Laser Diffraction Particle Size Analyser.

In certain embodiments, the toner of the present invention may comprise wax as a release agent. Accordingly, the processes of the present invention may comprise associating wax particles with the polyester resin particles and optional colorant particles (and optionally further particles as herein described). In such embodiments, preferably a wax dispersion is used in the processes. More preferably, a wax dispersion is prepared, which is then mixed with at least the aqueous dispersion(s) of polyester resin particles and optional colorant particles. The wax dispersion is preferably a dispersion in water i.e. is an aqueous dispersion. The wax dispersion is preferably prepared by the mixing together of a wax with an ionic surfactant to stabilise the wax particles in dispersion or the wax may be self-dispersing by virtue of acid or other polar functional groups on the wax which promote dispersion.

In cases where the wax dispersion is stabilised with an ionic surfactant, the surfactant preferably has the same polarity (and more preferably is the same surfactant) as the ionic surfactant used for the colorant dispersion and optional non-polyester resin dispersion and which is capable of being converted from an ionic to a non-ionic form (and vice versa) by a change in pH, i.e. is reversibly ionisable. Preferred reversibly ionisable ionic surfactants are described above, e.g. carboxy functional ionic surfactants. This is especially applicable in a preferred embodiment of the process wherein the association is caused by a pH switch process as described above. Examples of ionic and optionally non-ionic surfactants for the wax dispersion are the same as for the colorant dispersion described herein.

The wax should have a melting point (mpt) (as measured by the peak position by Differential Scanning Calorimetry (DSC)) of from 50 to 150° C., preferably from 50 to 130° C., more preferably from 50 to 110° C., especially from 65 to 85° C. If the melting point (mpt) is >150° C. the release properties at lower temperatures are inferior, especially where high print densities are used. If the mpt is <50° C. the storage stability of the toner will suffer, and the toner may be more prone to showing filming of the photoconductive component or metering blade.

The wax may comprise any suitable wax. Examples include hydrocarbon waxes (e.g. polypropylenes; polyethylenes, e.g. Polywax™ 400, 500, 600, 655, 725, 850, 1000, 2000 and 3000 from Baker Petrolite; paraffin waxes and waxes made from CO and $H_2$, especially Fischer-Tropsch waxes such as Paraflint™ C80 and H1 from Sasol); ester waxes, including synthetic ester waxes and natural waxes such as Carnauba and Montan waxes; amide waxes; and mixtures of these. Functional waxes, i.e. having functional groups, may also be used (e.g. acid functional waxes, such as those made using acidic monomers, e.g. ethylene/acrylic acid co-polymer, or grafted waxes having acid groups grafted onto the wax). Functional waxes may be dispersed with little or no ionic surfactant. Polar or functional waxes may be preferred for compatibility with the polyester resin. Functional waxes may also be used in combination with non-polar waxes (e.g. hydrocarbon waxes) wherein the functional wax may act as a compatibiliser between the non-polar wax and the polyester.

Where present, the amount of wax is preferably from 1 to 30% by weight based on the total weight of solids (as defined above), more preferably from 3 to 20% by weight, especially from 5 to 15% by weight. Too high a level of wax will reduce storage stability and lead to filming problems. The distribution of the wax through the toner is also an important factor, it being preferred that wax is substantially not present at the surface of the toner.

Where present, the volume average particle size of wax particles, in the dispersion, as measured by laser diffraction, is preferably in the range from 50 nm to 2 μm, more preferably from 100 to 800 nm, still more preferably from 150 to 600 nm, and especially from 200 to 500 nm. The wax particle size is chosen such that an even and consistent incorporation into the toner is achieved. A suitable measuring device for this purpose is the Coulter™ LS230 Laser Diffraction Particle Size Analyser.

The process may be very efficient at incorporating a wax in the toner in order to improve its release properties, as well as incorporating other components such as a charge control agent (CCA). The wax may be incorporated in the toner in relatively large amounts compared with some prior art processes.

The binder resin may comprise the polyester resin alone or in combination with one or more other (i.e. non-polyester) resin types (e.g. a vinyl resin). The polyester resin is preferably the major component (which includes the case where it is the only component) of the binder resin of the toner. In some preferred embodiments, the polyester resin is the only component of the binder resin (i.e. wherein the binder resin consists essentially of polyester resin). In some other embodiments, however, the polyester resin may be the minor component of the binder resin of the toner. In such cases where the polyester resin is not the only component of the binder resin, the non-polyester resin makes up the balance of the binder resin.

Accordingly, in embodiments, the processes of the present invention may include providing non-polyester resin particles in the aqueous dispersion and associating them with the self-dispersed polyester resin particles and optional colorant particles. Preferably, in such embodiments, the processes of the present invention may include providing a non-polyester resin dispersion, which contains non-polyester resin particles, preferably dispersed with ionic surfactant.

Preferably, the non-polyester resin dispersion is a dispersion of the non-polyester resin particles in water i.e. is an aqueous dispersion. The non-polyester resin dispersion preferably comprises an ionic surfactant, more preferably an ionic surfactant to stabilise the non-polyester resin particles in dispersion. Optionally, a non-ionic surfactant may also be incorporated into the resin dispersion. Examples of suitable surfactants are described above.

Preferably, the non-polyester resin dispersion is stabilised with an ionic surfactant, which has the same polarity (and more preferably is the same surfactant) as the ionic surfactant used for the optional colorant dispersion and any optional wax dispersion and which is capable of being converted from an ionic to a non-ionic form (and vice versa) by a change in pH, i.e. is reversibly ionisable. Preferred reversibly ionisable ionic surfactants are described above, e.g. carboxy functional ionic surfactants. This is especially applicable in a preferred embodiment of the process wherein the association is caused by a pH switch process as described above. Examples of ionic and optionally non-ionic surfactants for the non-polyester resin dispersion are the same as for the colorant and wax dispersions described herein.

The non-polyester resin may be prepared by polymerisation processes known in the art, preferably by emulsion polymerisation (especially for vinyl resin preparation and more especially styrene and/or acrylate resin preparation). The non-polyester resin dispersion is preferably prepared by emulsion polymerisation. The non-polyester resin preferably comprises a vinyl resin and, more preferably, the vinyl resin comprises a styrene and/or acrylate resin. A preferred non-polyester resin comprises a copolymer of (i) styrene or a substituted styrene (more preferably styrene), (ii) at least one alkyl acrylate or methacrylate and optionally (iii) an acid-functional or hydroxy-functional acrylate or methacrylate (especially a hydroxy-functional acrylate or methacrylate).

The molecular weight of the non-polyester resin can be controlled by use of a chain transfer agent (e.g. a mercaptan), by control of initiator concentration and/or by heating time.

The non-polyester resin may comprise a single non-polyester resin or may comprise a combination of two or more non-polyester resins.

The or each component of the non-polyester resin may be monomodal or bimodal in its molecular weight distribution. In one preferred embodiment, the non-polyester resin is provided by combining at least one non-polyester resin with monomodal molecular weight distribution with at least one non-polyester resin with bimodal molecular weight distribution. By a resin with a monomodal molecular weight distribution is meant one in which the Gel Permeation Chromatography (GPC) trace shows only one peak. By a resin with a bimodal molecular weight distribution is meant one where the GPC trace shows two peaks, or a peak and a shoulder.

The glass transition temperature (Tg) of the non-polyester resin is preferably from 30 to 100° C., more preferably from 45 to 75° C., most preferably from 50 to 70° C. If the Tg is too low, the storage stability of the toner will be reduced. If the Tg is too high, the melt viscosity of the resin will be raised, which will increase the fixation temperature and the temperature required to achieve adequate transparency.

The non-polyester resin particles may comprise particles made from one or more of the following preferred monomers for emulsion polymerisation: styrene and substituted styrenes; acrylate and methacrylate alkyl esters (e.g. butyl acrylate, butyl methacrylate, methyl acrylate, methyl methacrylate, ethyl acrylate or methacrylate, octyl acrylate or methacrylate, dodecyl acrylate or methacrylate etc.); acrylate or methacrylate esters with polar functionality, for example hydroxy or carboxylic acid functionality, hydroxy functionality being preferred (particularly 2-hydroxyethyl acrylate, 2-hydroxyethyl methacrylate, or hydroxy-terminated poly (ethylene oxide) acrylates or methacrylates, or hydroxy-terminated poly(propylene oxide) acrylates or methacrylates), examples of monomers with carboxylic acid functionality including acrylic acid and beta-carboxyethylacrylate; vinyl type monomers such as ethylene, propylene, butylene, isoprene and butadiene; vinyl esters such as vinyl acetate; other monomers such as acrylonitrile, maleic anhydride, vinyl ethers. The non-polyester resin preferably comprises a copolymer of two or more of the above monomers.

Preferred non-polyester resin particles include non-polyester resin particles which comprise one or more copolymers of (i) styrene or a substituted styrene (more preferably styrene), (ii) at least one alkyl acrylate or methacrylate and (iii) an acid-functional or hydroxy-functional acrylate or methacrylate (especially a hydroxy-functional acrylate or methacrylate).

The non-polyester resin may comprise one or more of the following non-polyester resins (which are not prepared by emulsion polymerization): polyurethane, hydrocarbon polymer, silicone polymer, polyamide, epoxy resin and other non-polyester resin known in the art as suitable for making toners.

The average size of the non-polyester resin particles, as measured using photon correlation spectroscopy, is preferably less than 200 nm and more preferably less than 150 nm. It is preferably more than 50 nm. The average size of the non-polyester resin particles may, for example lie in the range 80-120 nm.

The toner of the present invention may further comprise providing at least one charge control agent (CCA) to enhance the charging properties of the toner. Accordingly, the processes of the present invention may further comprise providing at least one CCA, for mixing with the particles before they are associated. Types of suitable CCA for use in toners are known in the art. For example, the CCA may be selected from such known classes of CCAs as: metal azo complexes, phenolic polymers and calixarenes, nigrosine, quaternary ammonium salts, arylsulphones, boron complexes (e.g. LR 147 (Japan Carlit)) and metal complexes of hydroxycarboxylic acids (especially of aromatic hydroxycarboxylic acids). A preferred CCA is a metal complex of a hydroxycarboxylic acid (especially of an aromatic hydroxycarboxylic acid). A preferred metal complex of an aromatic hydroxycarboxylic acids is selected from metal complexes of salicylic acid, bon acid and alkyl or aryl substituted derivatives thereof (specific examples include a metal complex of salicylic acid, a metal complex of di-tert butyl salicylic acid and a metal complex of bon acid). The metal in the metal complex is preferably a transition metal (e.g. titanium, vanadium, chromium, manganese, iron, cobalt, nickel, copper or zinc) or a group IIIB metal (e.g. aluminium or gallium), Preferred metals are selected from aluminium, chromium, manganese, iron, cobalt, nickel, copper or zinc (especially aluminium, zinc and chromium). Commercial CCA products which are metal complexes include Bontron™ E81, E82, E84 and E88 (Orient Chem Co.).

Preferred CCAs are colourless.

The CCA may be provided as a component of one of the resin, colorant and/or wax dispersions (preferably the colorant dispersion), or the CCA may be prepared separately, preferably as a solution or wet cake, and then mixed with the other dispersion(s), most preferably before association of the particles takes place. The CCA is preferably provided as a component of the colorant dispersion or is prepared as a solution or wet cake (especially a wet cake). The solution or wet cake is preferably aqueous.

Additionally or alternatively, a CCA may be added externally to the toner, in which case a suitable high-speed blender may be used, e.g. a Nara Hybridiser or Henschel blender. Where the CCA is added externally it is preferably added to the dried toner.

The amount of CCA, where present, is preferably from 0.1 to 10% by weight based on the total weight of solids (as defined above), more preferably from 0.5 to 5% by weight, especially from 1 to 4% by weight.

Alternatively, in embodiments, the toner of the present invention may be free of CCA (i.e. may not contain a CCA). In particular, the use of the polyester of the present invention may avoid the use of a CCA.

Within the scope of the invention and claims, in embodiments, the polyester resin dispersion, optional colorant dispersion, optional wax dispersion and optional non-polyester resin dispersion are separate dispersions which are then mixed. However, any two or more of the polyester resin particles, colorant particles, optional wax particles and optional non-polyester particles may be prepared in the same dispersion. For instance, in certain embodiments, the polyester resin particles may be prepared in a dispersion along with either or both of the colorant and/or wax particles (especially the colorant particles), such that the polyester resin, colorant and/or wax dispersions (i.e. including any two of these) may be one and the same dispersion. It is also possible that the non-polyester resin particles and one or both of the colorant and wax particles are prepared in one dispersion, such that the non-polyester resin, colorant and/or wax dispersions are one and the same dispersion. It is also possible that the colorant and wax particles are prepared in one dispersion so that the colorant and wax dispersions are one and the same dispersion.

Preferably, each dispersion in the processes of the present invention is a dispersion in water, i.e. is an aqueous dispersion.

Mixing together of the dispersions may be performed by any conventional method of mixing dispersions. The mixing may include a low shear energy step (e.g. using a low shear stirring means) and/or a high shear energy step (e.g. using a rotor-stator type mixer). The mixed dispersions may be heated at a temperature below the glass transition temperature (Tg) of the binder resin prior to association of the particles, e.g. to aid homogenisation of the mixture of particles.

The toner particles, especially the recovered and dried toner particles, may be blended with one or more surface additives to improve the powder flow properties of the toner, or to tune the tribocharge or other properties, as is known in the art. Typical surface additives include, but are not limited to inorganic oxides, carbides, nitrides and titanates (oxides are preferred). Inorganic oxides include silica and metal oxides such as titania and alumina. Silica, titania and alumina are preferred. Silica is most preferred. Organic additives include polymeric beads (for example acrylic or fluoropolymer beads) and metal stearates (for example zinc stearate). Conducting additive particles may also be used, including those based on tin oxide (e.g. those containing antimony tin oxide or indium tin oxide).

Each surface additive may be used at 0.1-5.0 wt % based on the weight of the unblended toner (i.e. the toner prior to addition of the surface additive), preferably 0.2-3.0 wt %, more preferably 0.25-2.0 wt %. The total level of surface additives used may be from about 0.1 to about 10 wt %, preferably from about 0.5 to 5 wt %, based on the weight of the unblended toner. Preferably, the surface additives comprise silica in an amount 0.5 to 5 wt % (more preferably 1 to 4 wt % and most preferably 1 to 3 wt %).

The additives may be added by blending with the toner, using, for example, a Henschel blender, a Nara Hybridiser, or a Cyclomix blender (available from Hosokawa).

The particles of the above surface additives, including silica, titania and alumina, preferably may be made hydrophobic, e.g. by reaction with a silane and/or a silicone polymer. Examples of hydrophobising groups include alkyl halosilanes, aryl halosilanes, alkyl alkoxysilanes (e.g. butyl trimethoxysilane, iso-butyl trimethoxysilane and octyl trimethoxysilane), aryl alkoxysilanes, hexamethyldisilazane, dimethylpolysiloxane and octamethylcyclotetrasiloxane. Other hydrophobising groups include those containing amine or ammonium groups. Mixtures of hydrophobising groups can be used (for example mixtures of silicone and silane groups, or alkylsilanes and aminoalkylsilanes.)

Examples of hydrophobic silicas include those commercially available from Nippon Aerosil, Degussa, Wacker-Chemie and Cabot Corporation. Specific examples include those made by reaction with dimethyldichlorosilane (e.g. Aerosil™ R972, R974 and R976 from Degussa); those made by reaction with dimethylpolysiloxane (e.g. Aerosil™ RY50, NY50, RY200, RY200S and R202 from Degussa); those made by reaction with hexamethyldisilazane (e.g. Aerosil™ RX50, NAX50, RX200, RX300, R812 and R812S from Degussa); those made by reaction with alkysilanes (e.g. Aerosil™ R805 and R816 from Degussa) and those made by reaction with octamethylcyclotetrasiloxane (e.g. Aerosil™ R104 and R106 from Degussa).

The average primary particle size of suitable surface additives, especially silicas, is typically from 5 to 200 nm, preferably from 7 to 50 nm. The BET surface area of the additives, especially silicas, may be from 10 to 350 $m^2/g$, preferably 30-300 $m^2/g$. Combinations of additives, especially silicas, with different particle size and/or surface area may be used.

It is possible to blend the different size additives in a single blending step, but is often preferred to blend them in separate blending steps. In this case, the larger additive may be blended before or after the smaller additive. It may further be preferred to use two stages blending, where in at least one stage a mixture of additives of different particle size is used. For example, an additive with low particle size may be used in the first stage, with a mixture of additives of different particle size in the second step.

Where titania is used, it is preferred to use a grade which has been hydrophobised, e.g. by reaction with an alkylsilane and/or a silicone polymer. The titania may be crystalline and/or amorphous. Where crystalline it may consist of rutile or anatase structures, or mixtures of the two. Examples include grades T805 or NKT90 from Nippon Aerosil and STT-30A from Titan Kogyo.

Hydrophilic or hydrophobic grades of alumina may be used. An example is Aluminium Oxide C from Degussa.

It is often preferred to use combinations of silica and titania, or of silica, titania and alumina. Combinations of large and small silicas, as described above, can be used in conjunction with titania, alumina, or with blends of titania and alumina. It is also often preferred to use silica alone. In that case, combinations of large and small silicas, as described above, can be used.

Preferred formulations of surface additives include those in the following list:

- hydrophobised silica;
- large and small particle size silica combinations, which silicas may be optionally hydrophobised;
- hydrophobised silica and one or both of hydrophobised titania and hydrophilic or hydrophobised alumina;
- large and small particle size silica combinations as described above; and
- one or both of hydrophobised titania and hydrophilic or hydrophobised alumina.

Polymer beads or zinc stearate may be used to improve the transfer efficiency or cleaning efficiency of the toners. Charge control agents (CCAs) may be added in the external formulation (i.e. surface additive formulation) to modify the charge level or charging rate of the toners.

The processes according to the present invention may be suitable for producing a toner of narrow particle size distribution.

The toner comprises toner particles. Particle size distribution of the toner may be measured by the $GSD_n$ and $GSD_v$ values. (GSD=Geometric Size Distribution).

The $GSD_n$ value is defined by the following expression:

$$GSD_n = D_{50}/D_{15.9}$$

wherein $D_{50}$ is the particle size below which 50% by number of the toner particles have their size and $D_{15.9}$ is the particle size below which 15.9% by number of the toner particles have their size.

A $GSD_v$ value is defined by the following expression:

$$GSD_v = D_{84.1}/D_{50}$$

wherein $D_{84.1}$ is the particle size below which 84.1% by volume of the toner particles have their size and $D_{50}$ is the particle size below which 50% by volume of the toner particles have their size.

Low GSD values may be preferred for many applications. A low GSD provides, among other things, that the toner may possess a more uniform charge distribution leading to improved image quality and higher resolution and have a lower tendency toward filming.

The volume average particle size of the toner is preferably in the range from 2 to 20 μm, more preferably 4 to 10 μm, still more preferably 5 to 9 μm.

Preferably, the volume average particle size and the particle size distribution ($GSD_n$ and $GSD_v$) refer to sizes as measured using a Coulter™ counter fitted with a 50 μm or 100 μm aperture. For example, a Coulter™ Multisizer III instrument may be used. The Coulter™ counter measurement may be conveniently obtained in the present invention by analysing the dispersion of toner particles produced after the fusion step of the process.

The toner according to the present invention preferably has a mean circularity, as hereinafter defined, of the toner particles as measured by a Flow Particle image Analyser of at least 0.90, more preferably of at least 0.93. The mean circularity is preferably up to 0.99.

The circularity measured by use of a Flow Particle Image Analyser (Sysmex FPIA) is defined as the ratio:

$$Lo/L$$

where Lo is the circumference of a circle of equivalent area to the particle, and L is the perimeter of the particle itself.

Further preferably, the shape factor of the toner particles, SF1, as hereinafter defined, is at most 165, more preferably at most 155.

Additionally preferably, the shape factor of the toner particles, SF2, as hereinafter defined, is at most 155, more preferably at most 145.

The shape factors SF1 and SF2 of the toner may be measured by image analysis of images generated by scanning electron microscopy (SEM).

The shape factor, SF1, is defined as:

$$SF1=(ML)^2/A\times\lambda/4\times100,$$ where $ML$=maximum length across toner, $A$=projected area.

The shape factor, SF2, is defined as:

$$SF2=P^2/A\times1/4\pi\times100,$$ where $P$=the perimeter of the toner particle, $A$=projected area.

An average of approximately 100 particles is taken to define the shape factors (SF1 and SF2) for the toner.

The smoothness of the toner after the coalescence (fusion) stage may also be assessed by measuring the surface area of the toner, for example by the BET method. It is preferred that the BET surface area of the unblended toner (i.e. without surface additives) is in the range 0.5-1.5 $m^2/g$.

Toner having the above shape properties has been found to have high transfer efficiency from the photoconductor to a substrate (or to an intermediate transfer belt or roller), in some cases close to 100% transfer efficiency.

If the toner is designed for a printer or copier which does not employ a mechanical cleaning device, it may be preferred to fuse (coalesce) the toner in the fusion step until a substantially spherical shape is attained, e.g. wherein the mean circularity is at least 0.98. If, however, the toner is designed for use in a printer or copier in which a mechanical cleaning device is employed to remove residual toner from the photoconductor after image transfer, it may be preferred to select a smooth but off-spherical shape, where the mean circularity is in the range 0.90-0.99, preferably 0.93-0.98, more preferably 0.94-0.98 and still more preferably 0.94-0.96. In the smooth but off-spherical shape, SF1 is particularly preferably 110-150 and SF2 is particularly preferably 110-145.

Where a wax is used in the process to obtain the toner, the wax may be present in the toner in domains of mean diameter 2 μm or less, preferably 1.5 μm or less. If the mean size of any wax domains is >2 μm, the transparency of the printed film may be reduced, and the storage stability may decrease. The domain size values are preferably those measured by analysing sections of the toner by transmission electron microscopy (TEM). Alternatively, wax may not be visible by TEM at all, especially if the wax is efficiently dispersed. Preferably the wax is not substantially present at the surface of the toner.

The toner may be used alone as a mono-component developer or as a dual component (i.e. two-component) developer. In the latter case the toner is mixed with a suitable (magnetic) carrier bead.

Advantageously, the toner may be capable of fixing to the substrate at low temperatures by means of heated fusion rollers where no release oil is applied and may be capable of releasing from the fusion rollers over a wide range of fusion temperatures and speeds, and over a wide range of toner print densities. The toner may also be capable of fixing to the substrate by means of radiant heat. Furthermore, preferably, the toner according to the invention does not lead to background development of the photoconductor (e.g. OPC) and preferably does not lead to filming of the metering blade or development roller (for a mono-component device) or the carrier bead (for a dual-component device), or of the photoconductor.

Preferably, the haze values of prints using the toner of the invention do not vary considerably with fusion temperature. Haze may be assessed using a spectrophotometer, for example a Minolta CM-3600d, following ASTM D 1003. Preferably, the haze at a print density of 1.0 mg/cm$^2$ is below 40, preferably below 30, and the ratio of the values at fusion temperatures of 130 and 160° C. is preferably at most 1.5, more preferably 1.3 and most preferably 1.2.

The process can produce a toner which may be capable of one or more of the following: fixing to a substrate at low temperatures by means of heated fusion rollers; releasing from the fusion rollers over a wide range of fusion temperatures and speeds, and over a wide range of toner print densities; possessing good storage stability, print transparency, toner charging characteristics and does not lead to background development of the photoconductor; not leading to filming of the metering blade or development roller (for a mono-component device) or the carrier bead (for a dual-component device), or of the photoconductor; having high transfer efficiency from the photoconductor to the substrate or intermediate transfer belt or roller and from the transfer belt or roller (where used) to the substrate; enabling efficient cleaning of any residual toner remaining after image transfer where a mechanical cleaning device is used.

The toner of the invention may be particularly suitable for use in an electroreprographic apparatus or method where one or more of the following hardware conditions of an electroreprographic device applies:

i) where the device contains a developer roller and metering blade (i.e. where the toner is a mono-component toner);
ii) where the device contains a cleaning device for mechanically removing waste toner from the photoconductor;
iii) where the photoconductor is charged by a contact charging means;
iv) where contact development takes place or a contact development member is present;
v) where oil-less fusion rollers are used;
vi) where the above devices are four colour printers or copiers, including tandem machines Preferably, the invention provides a toner which satisfies many requirements simultaneously. The toner may be particularly advantageous for use in a mono-component or dual-component electroreprographic apparatus and may be capable of demonstrating: formation of high resolution images; release from oil-less fusion rollers over a wide range of fusion temperature and print density; high transparency for OHP slides over a wide range of fusion temperature and print density; high transfer efficiency and the ability to clean any residual toner from the photoconductor, and the absence of filming of the metering blade, development roller and photoconductor over a long print run.

The toner particles obtainable by the process of the present invention may be used in a two component developer. In the developer, the toner particles are mixed with magnetic carrier particles.

The magnetic carrier particles are not particularly limited and those carriers known in the art may be used. The magnetic carrier particles may for instance comprise available and/or generally known magnetic carrier particles such as: iron powder, which may or may not be surface oxidised; magnetic ferrite and/or magnetite particles. Carrier particles may be alloys with, mixed oxides with, or doped with other metals such lithium, calcium, magnesium, nickel, copper, zinc, cobalt, manganese, chromium and/or rare-earth elements. Other carriers may include magnetic material-dispersed resin carriers comprising a binding resin having a magnetic material dispersed therein.

Preferably, the magnetic carrier particles comprise at least iron. More preferably, the magnetic carrier particles comprise magnetite particles and/or magnetic ferrite particles. Such ferrites may or may not contain one or more other elements selected from, for example, lithium (Li), calcium (Ca), magnesium (Mg), nickel (Ni), copper (Cu), zinc (Zn), cobalt (Co), manganese (Mn), chromium (Cr), strontium (Sr) and/or rare-earth elements and the like. Examples of such other magnetic ferrites include CuZn ferrite, CuZnMg ferrite, CuMg ferrite, LiMgCa ferrite, MnMg ferrite MnMgSr ferrite, Mg ferrite, Mn ferrite, Sr ferrite and the like.

The magnetic carrier particles may comprise a structure wherein a magnetic material constitutes a core which is treated (e.g. surface coated), e.g. with an organic material, such as a resin (e.g. a silicone or a fluorine containing resin), as known in the art. The magnetic material core may, for instance, comprise any of the materials for the magnetic carrier particles mentioned above, preferably magnetite or magnetic ferrite, optionally containing one or more other elements selected from, for example, lithium, calcium, magnesium, nickel, copper, zinc, cobalt, manganese, chromium and/or rare-earth elements and the like. Examples of the coating resin include a fluorine containing resin, an epoxy resin, a polyester resin, an acrylate resin, a fluorine-acrylate resin, an acrylate-styrene resin, a silicone resin or a modified silicone resin (e.g. a silicone-acrylate resin). Among the more common coatings are a silicone resin, an acrylate resin, a silicone-acrylate resin and a fluorine containing resin).

The magnetic carrier particles may have a number average particle diameter in the range from 20 to 400 μm, preferably 20 to 200 μm, more preferably 30 to 150 μm, especially 30 to 100 μm. Sizes may be measured using the Coulter™ counter method described above.

The two component developer is preferably prepared by a method comprising preparing a toner by a process according to the present invention, and then mixing said toner with magnetic carrier particles.

The toner particles and the carrier particles may be mixed together in such a manner that the content of the toner particles (i.e. toner concentration) in the developer is preferably 1 to 20% by weight (based on the total weight of the developer, i.e. toner particles plus carrier particles), more preferably 2 to 15% by weight, still more preferably 3 to 12% by weight.

Prior to mixing the magnetic carrier and the toner it is preferable to blend the toner with one or more surface additives as described above. As described above toner particles are preferably recovered and dried prior to blending with surface additives.

The two component developer may be present in a developer cartridge having at least one chamber containing the developer.

The cartridge preferably further has a toner supply means for supplying further toner particles to the two component developer. The toner supply means may be, e.g., a toner cartridge or bottle. The cartridge is for use in a developing device, e.g. a copier and/or printer. In operation, for a developing device employing a two component developer, the chamber of the developer cartridge, where the two component developer comprising the carrier is located, has a working concentration of toner present. As toner is consumed by forming toner images, further (i.e. fresh) toner is supplied by suitable toner supply means (e.g. a cartridge or bottle) to maintain the working toner concentration in the developer. The fresh toner is typically added at the rate at which it is consumed from the developer, with the carrier being reused.

Advantageously, the toner particles made by the process of the present invention may be charged efficiently by contact with carrier particles and thus be capable of efficient development of an electrostatic latent image. In particular, the abovementioned two component developer provides quick development of the desired tribocharge on the toner particles during activation. In addition, the tribocharge on the toner during continued activation tends to be maintained at a relatively stable value. Tribocharge values of toners may readily be measured by, for example, using an Epping™ q/m meter.

Throughout the description and claims of this specification, the words "comprise" and "contain" and variations of the words, for example "comprising" and "comprises", mean "including but not limited to", and are not intended to (and do not) exclude other components and/or steps.

Unless the context clearly indicates otherwise, plural forms of the terms herein are to be construed as including the singular form and vice versa.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

It will be appreciated that many of the features described above, particularly of the preferred embodiments, are inventive in their own right and not just as part of an embodiment of the present invention. Independent protection may be sought for these features in addition to or alternative to any invention presently claimed.

Any discussion of documents, acts, materials, devices, articles and the like included herein is solely for the purpose of providing a context for the present invention. It is not suggested or represented that any or all of these matters formed part of the prior art or were common general knowledge in the field relevant to the present invention as it existed before the priority date or filing date of this patent application.

The invention will now be illustrated by the following Examples, which are non-limiting on the scope of the invention. All percentages or parts referred to are percentages or parts by weight unless otherwise stated.

EXAMPLES

1. Method for Measuring the Resin Particle Size of the Polyester Dispersions

The mean particle size of the resin particles in the polyester dispersions was measured using Transmission Electron Microscopy (TEM). The mean (i.e. number average) particle size was calculated from measurements of between 290 and 500 particles.

2. Polyesters 2.1 Polyester 1

A polyester having a proportion of carboxylic acid end-groups was obtained and characterised by Gel Permeation Chromatography (GPC) which showed a number average molecular weight, Mn=2,700 and a weight average molecular weight, Mw=7,700. The glass transition temperature (Tg) as measured by Differential Scanning Calorimetry (DSC) was 64° C. The acid value (AV) for the polyester was 33 mg KOH/g.

2.2 Polyester 2

A polyester having a proportion of carboxylic acid end-groups was obtained and characterised by GPC which showed Mn=3,300 and Mw=10,300. The Tg as measured by DSC was 61° C. The acid value (AV) for the polyester was 23 mg KOH/g.

2.3 Polyester 3

A polyester having a proportion of carboxylic acid end-groups was obtained and characterised by GPC which showed Mn=2,700 and Mw=8,500 The Tg as measured by DSC was 60° C. The acid value (AV) for the polyester was 2 mg KOH/g.

3. Polyester Dispersions 3.1 Aqueous Polyester Dispersion A Containing Polyester 1

Polyester 1 (32.5 g) and dichloromethane (97.5 g) were added to a flask and mixed to dissolve the polyester. Then a dilute solution of sodium hydroxide (pH 12.1, 130 g) was added, and the mixing continued to form a dispersion. The pH of the dispersion was further adjusted by the addition of 0.5M sodium hydroxide solution (14.0 g). The dispersion was then passed four times through a Microfluidizer™ M110-T. After each pass the pH was measured and adjusted, if necessary to above 6.0 with sodium hydroxide solution.

Several dispersions were prepared in the same manner as described above, and combined. The dichloromethane solvent was then removed under reduced pressure using a Rotavapor, and then the dispersion was filtered through a 10 μm mesh. The final dispersion (Aqueous Polyester Dispersion A) had a solid content of 30.5 wt %.

Analysis by headspace Gas chromatography Mass spectrometry (GC-MS) showed that the retained level of dichloromethane in the dispersion was 70 ppm (by weight). Analysis of the dried-down dispersion by TEM showed that the mean particle size of the dispersion was 49 nm.

3.2 Aqueous Polyester Dispersion B Containing Polyester 2

Dispersions of Polyester 2 were prepared in exactly the same way as those of Polyester 1 as described above in step 3.1, except that Polyester 2 was used in place of Polyester 1.

The resulting dispersions were combined. The final combined dispersion of Polyester 2 had a solid content of 28.9 wt %, this was Aqueous polyester Dispersion B.

Analysis by headspace GC-MS showed that the retained level of dichloromethane in the dispersion was 40 ppm (by weight). Analysis of the dried-down dispersion by TEM showed that the mean particle size of the dispersion was 79 nm.

3.3 Aqueous Polyester Dispersion C Containing Polyester 3

Dispersions of Polyester 3 were prepared in exactly the same way as those of Polyester 1 as described in step 3.1, except that Polyester 3 was used in place of Polyester 1. The resulting dispersions were combined. The final combined dispersion of Polyester 3 had a solid content of 30.3 wt %, this was Aqueous Polyester Dispersion C.

Analysis by headspace GC-MS showed that the retained level of dichloromethane in the dispersion was 51 ppm. Analysis of the dried-down dispersion by TEM showed that the mean particle size of the dispersion was 109 nm.

3.4 Aqueous Polyester Dispersion D Containing Polyester 4

Aqueous Polyester Dispersion D was made from a polyester resin with a proportion of carboxylic acid end groups. Characterisation by GPC showed a number average molecular weight, Mn=4,000 and a weight average molecular weight, Mw=16,900. The glass transition temperature (Tg) was measured by differential scanning calorimetry (dsc) as 63° C. The acid value (AV) for the polyester was measured as 10 mgKOH/g.

Analysis of the dried-down dispersion by TEM showed that the mean particle size of the dispersion was 54 nm.

3.5 Aqueous Polyester Dispersion E Containing Polyester 5

Aqueous Polyester Dispersion E was made from a polyester resin with a proportion of carboxylic acid end groups. Characterisation by GPC showed a number average molecular weight, Mn=4,500 and a weight average molecular weight, Mw=18,700. The glass transition temperature (Tg) was measured by differential scanning calorimetry (dsc) as 65° C. The acid value (AV) for the polyester was measured as 10 mgKOH/g.

Analysis of the dried-down dispersion by TEM showed that the mean particle size of the dispersion was 65 nm.

3.6 Aqueous Polyester Dispersion F Containing Polyester 6

Aqueous Polyester Dispersion F was made from a polyester resin with a proportion of carboxylic acid end groups. The molecular weight of the resin used in Aqueous Polyester Dispersion F is higher than that of the resins used in Aqueous Polyester Dispersions D and E. Characterisation by GPC showed a number average molecular weight, Mn=5,900 and a weight average molecular weight, Mw=33,300. The glass transition temperature (Tg) was measured by differential scanning calorimetry (dsc) as 65° C. The acid value (AV) for the polyester was measured as 6 mgKOH/g.

Analysis of the dried-down dispersion by TEM showed that the mean particle size of the dispersion was 60 nm.

4. Pigment Dispersions 4.1 Preparation of Pigment Dispersion 1

A dispersion of C.I. Pigment Blue 15:3 was prepared as follows. A mixture of pigment (100 parts), Akypo™ RLM100 (10 parts of active surfactant) and Solsperse™ 27,000 (10 parts) was milled in water using a bead mill. Solsperse™ 27,000 is a non-ionic surfactant available from Noveon. This prepared Pigment Dispersion 1 which had a total solids content of 30.2 wt % including surfactants.

4.2 Preparation of Pigment Dispersion 2

A dispersion of C.I. Pigment Blue 15:3 was prepared as follows. A mixture of pigment (100 parts), Akypo™ RLM100 (10 parts of active surfactant) and Solsperse™ 27,000 (10 parts) was milled in water using a bead mill. This prepared Pigment Dispersion 2, having a total solids content of 30.4 wt % including surfactants.

4.3 Preparation of Pigment/CCA Dispersion 3

A dispersion of C.I. Pigment Blue 15:3 and CCA Bontron™ E88 (from Orient) was prepared as follows. A mixture of the pigment (75 parts), Bontron™ E88 (25 parts), Akypo™ RLM100 (10 parts of active surfactant) and Solsperse™ 27,000 (10 parts) was milled in water using a bead mill. This prepared Pigment/CCA Dispersion 3, having a total solids content of was 31.7 wt % including surfactants.

5. Wax Dispersions 5.1 Wax Dispersion 1

A dispersion of carnauba wax in water was prepared as follows. The carnauba wax was melt dispersed in water with Akypo™ RLM100 (Kao) surfactant. The total solids of the dispersion, including surfactant, was 25.3% by weight.

5.2 Wax Dispersion 2

A wax mixture comprising 80 parts by weight Paraflint™ C80 (a Fischer-Tropsch wax) and 20 parts by weight carnauba wax was melt dispersed in water, with Akypo™ RLM100 (Kao) as surfactant. The Akypo™ surfactant was used in an amount of 20% by weight based on the total solid content (wax and surfactant) of the dispersion. The total solids content of the dispersion was 25.9% by weight including surfactant.

6. Toner Preparation 6.1 Example 1 - Preparation of a Toner Containing Aqueous Polyester Dispersion A Aqueous Polyester Dispersion A (308.9 g), Pigment Dispersion 1 (24.3 g) and deionised water (618.2 g) were added to a glass vessel equipped with an agitator and a condenser to form a mixture. Temperature control was provided by means of heated water passed through the jacket of the vessel. The mixture was stirred and the jacket temperature raised to 35° C. The mixture was then circulated through a high shear mixer and back into the vessel, during which 4% sulphuric acid (48.8 g) was added into the high shear mixer over 3 minutes to reduce the pH to approximately 2 in order to effect association of the polyester and pigment particles. After completion of the acid addition the circulation and high shear mixing were continued for a further minute. The temperature was then raised to 46° C. over 25 minutes to allow formation of aggregate particles of the desired size.

An aqueous solution of sodium dodecylbenzenesulphonate (10 wt %, 25.0 g) was added to the stirred mixture, followed by 0.5M sodium hydroxide solution (64.5 g) to raise the pH to 7.6. The temperature was then raised to 91° C. over 45 minutes, and held at this value for a further 105 minutes to fuse the toner particles.

Analysis using a Coulter Multisizer III fitted with a 50 μm aperture gave a volume mean particle size of 9.0 μm and a particle size distribution, GSDv=1.28. Visual inspection using an optical microscope showed that the particles were of uniform size and slightly irregular in shape.

6.2 Example 2 - Preparation of a Toner Containing Aqueous Polyester Dispersion B Aqueous Polyester Dispersion B (260.3 g), Pigment Dispersion 1 (19.4 g) and deionised water (483.5 g) were added to a glass vessel equipped with an agitator and a condenser to form a mixture. Temperature control was provided by means of heated water passed through the jacket of the vessel. The mixture was stirred and the jacket temperature raised to 35° C. The mixture was then circulated through a high shear mixer and back into the vessel, during which 4% sulphuric acid (37.2 g) was added into the high shear mixer over 3 minutes to reduce the pH to approximately 2 in order to effect association of the polyester and pigment particles. After completion of the acid addition the circulation and high shear mixing were continued for a further minute. The temperature was then raised to 44° C. over 20 minutes and this temperature held for a further 30 minutes to allow formation of aggregate particles of the desired size.

An aqueous solution of sodium dodecylbenzenesulphonate (10 wt %, 20.1 g) was added to the stirred mixture, followed by 0.5M sodium hydroxide solution (69.5 g) to raise the pH to 7.4. The temperature was then raised to 91° C. over 35 minutes and held at this value for a further 100 minutes to fuse the toner particles.

Analysis using a Coulter Multisizer III fitted with a 50 μm aperture gave a volume mean particle size of 9.6 μm and a particle size distribution, GSDv=1.35. Visual inspection using an optical microscope showed that the particles were of uniform size and irregular in shape.

6.3 Example 3 - Preparation of a Toner Containing Aqueous Polyester Dispersion D Aqueous Polyester Dispersion D (922 g), Pigment Dispersion 1 (72.8 g) and deionised water (875 g) were added to a glass vessel equipped with an agitator and a condenser to form a mixture. Temperature control was provided by means of heated water passed through the jacket of the vessel. The mixture was stirred and the jacket temperature raised to 31° C. The mixture was then circulated through a high shear mixer and back into the vessel, during which 2% sulphuric acid (130 g) was added into the high shear mixer over 4 minutes to reduce the pH to 3.4 in order to effect association of the polyester and pigment particles. After completion of the acid addition the circulation and high shear mixing were continued for a further minute. The temperature was then raised to 48° C. over 39 minutes and this temperature held for a further 145 minutes to allow formation of aggregate particles of the desired size.

An aqueous solution of sodium hydroxide (0.5M, 85 g) was added to the stirred mixture to raise the pH to 7.0. The temperature was then raised to 92° C. over 52 minutes to fuse the toner particles.

Analysis using a Coulter Multisizer III fitted with a 50 μm aperture gave a volume mean particle size of 7.5 μm and a particle size distribution, GSDv=1.26. Visual inspection using an optical microscope showed that the particles were of uniform size and irregular in shape.

6.4 Example 4 - Preparation of a Toner Containing Aqueous Polyester a Dispersion D and Wax Dispersion 1

Aqueous Polyester Dispersion D (874.8 g), Pigment Dispersion 1 (72.8 g), Wax Dispersion 1 (68.2 g) and deionised water (854 g) were added to a glass vessel equipped with an agitator and a condenser to form a mixture. Temperature control was provided by means of heated water passed through the jacket of the vessel. The mixture was stirred and the jacket temperature raised to 31° C. The mixture was then circulated through a high shear mixer and back into the vessel, during which 2% sulphuric acid (130 g) was added into the high shear mixer over 4 minutes to reduce the pH to 4.5 in order to effect association of the polyester and pigment particles. After completion of the acid addition the circulation and high shear mixing were continued for a further minute. The temperature was then raised to 46° C. over 25 minutes and this temperature held for a further 150 minutes to allow formation of aggregate particles of the desired size.

An aqueous solution of sodium hydroxide (0.5M, 59 g) was added to the stirred mixture to raise the pH to 7.0. The temperature was then raised to 92° C. over 50 minutes to fuse the toner particles.

Analysis using a Coulter Multisizer III fitted with a 50 μm aperture gave a volume mean particle size of 6.6 μm and a particle size distribution, GSDv=1.19. Visual inspection using an optical microscope showed that the particles were of uniform size and irregular in shape.

6.5 Example 5 - Preparation of a Toner Containing Aqueous Polyester Dispersion E and Wax Dispersion 2

Aqueous Polyester Dispersion E (892.5 g), Pigment Dispersion 1 (72.3 g), Wax Dispersion 2 (35.6 g) and deionised water (870 g) were added to a glass vessel equipped with an agitator and a condenser to form a mixture. Temperature control was provided by means of heated water passed through the jacket of the vessel. The mixture was stirred and the jacket temperature raised to 31° C. The mixture was then circulated through a high shear mixer and back into the vessel, during which 2% sulphuric acid (130 g) was added into the high shear mixer over 4 minutes to reduce the pH to 3.7 in order to effect association of the polyester and pigment particles. After completion of the acid addition the circulation and high shear mixing were continued for a further minute. The temperature was then raised to 48° C. over 130 minutes and then held at 48-50° C. for a further 65 minutes to allow formation of aggregate particles of the desired size.

An aqueous solution of sodium hydroxide (0.5M, 65.4 g) was added to the stirred mixture to raise the pH to 7.0. The temperature was then raised to 90° C. over 40 minutes, and then held at 90° C. for a further 15 minutes to fuse the toner particles.

Analysis using a Coulter Multisizer III fitted with a 50 μm aperture gave a volume mean particle size of 7.1 μm and a particle size distribution, GSDv=1.24. Visual inspection using an optical microscope showed that the particles were of uniform size and irregular in shape.

6.6 Example 6 - Preparation of a Toner Containing Aqueous Polyester Dispersion E and CCA Aqueous Polyester Dispersion E (902 g), Pigment/CCA Dispersion 3 (91.8 g) and deionised water (902 g) were added to a glass vessel equipped with an agitator and a condenser to form a mixture. Temperature control was provided by means of heated water passed through the jacket of the vessel. The mixture was stirred and the jacket temperature raised to 31° C. The mixture was then circulated through a high shear mixer and back into the vessel, during which 2% sulphuric acid (130 g) was added into the high shear mixer over 3 minutes to reduce the pH to 4.2 in order to effect association of the polyester and pigment particles. After completion of the acid addition the circulation and high shear mixing were continued for a further minute. The temperature was then raised to 49° C. over 30 minutes and this temperature held for a further 140 minutes to allow formation of aggregate particles of the desired size.

An aqueous solution of sodium hydroxide (0.5M, 65 g) was added to the stirred mixture to raise the pH to 7.0. The temperature was then raised to 91° C. over 40 minutes to fuse the toner particles.

Analysis using a Coulter Multisizer III fitted with a 50 μm aperture gave a volume mean particle size of 7.4 μm and a particle size distribution, GSDv=1.22, Visual inspection using an optical microscope showed that the particles were of uniform size and smooth, off-spherical in shape.

6.7 Example 7 - Preparation of a Toner Containing Aqueous Polyester Dispersions D and F (of Different Molecular Weight)

Aqueous Polyester Dispersion D (471.2 g), Polyester Dispersion F (119.1 g), Pigment Dispersion 1 (51.1 g), Wax Dispersion 1 (89.9 g) and deionised water (1280 g) were added to a glass vessel equipped with an agitator and a condenser to form a mixture. Temperature control was provided by means of heated water passed through the jacket of the vessel. The mixture was stirred and the jacket temperature raised to 35° C. The mixture was then circulated through a high shear mixer and back into the vessel, during which 4% sulphuric acid (91.0 g) was added into the high shear mixer over 3 minutes to reduce the pH to approximately 2 in order to effect association of the polyester and pigment particles. After completion of the acid addition the circulation and high shear mixing were continued for a further minute. The temperature was then raised to 47° C. over 20 minutes and this temperature held for a further 60 minutes to allow formation of aggregate particles of the desired size.

An aqueous solution of sodium hydroxide (0.5M, 120.4 g) was added to the stirred mixture to raise the pH to 7.5. The temperature was then raised to 93° C. over 75 minutes to fuse the toner particles.

Analysis using a Coulter Multisizer III fitted with a 50 μm aperture gave a volume mean particle size of 6.5 μm and a particle size distribution, GSDv=1.20. Visual inspection using an optical microscope showed that the particles were of uniform size and smooth, off-spherical in shape.

6.8 Comparative Example - Toner Containing Aqueous Polyester Dispersion C with an Acid Value<5 mg KOH/q Aqueous Polyester Dispersion C (248.5 g), Pigment Dispersion 2 (19.3 g) and deionised water (514.9 g) were added to a glass vessel equipped with an agitator and a condenser to form a mixture. Temperature control was provided by means of heated water passed through the jacket of the vessel. The mixture was stirred and the jacket temperature raised to 35° C. The mixture was then circulated through a high shear mixer and back into the vessel, during which 4% sulphuric acid (18.2 g) was added into the high shear mixer over 3 minutes to reduce the pH to approximately 2 in order to effect association of the polyester and pigment particles. After completion of the acid addition the circulation and high shear mixing were continued for a further minute. To allow the formation of aggregate particles of the desired size, the temperature was then held at 35° C. for 85 minutes.

An aqueous solution of sodium dodecylbenzenesulphonate (10 wt %, 20.0 g) was added to the stirred mixture, followed by 0.5M sodium hydroxide solution (24.6 g) to raise the pH to 7.8. At this point analysis of the un-fused particles using a Coulter Multisizer III fitted with a 50 μm aperture gave a volume mean particle size of 6.1 μm and a particle size distribution, GSDv=1.24. The temperature was then raised to 91° C. over 60 minutes, at which point uncontrolled coagulation of the dispersion occurred.

The invention claimed is:

1. A process for preparing a toner comprising a binder resin and a colorant, wherein the binder resin comprises a polyester resin having an acid value greater than 5 mg KOH/g, the process comprising:

providing an aqueous dispersion of neutralised self-dispersed polyester resin particles and colorant particles stabilised by an ionic surfactant, wherein the acid groups on the polyester resin and the ionic surfactant in the dispersion are reversibly ionisable or de-ionisable;

associating the polyester resin particles and colorant particles by means of a change in the pH of the dispersion which causes the neutralised acid groups of the polyester and ionic surfactant to convert from an ionic to a non-ionic state; and a further step of heating, stirring or heating and stirring the associated particles at a temperature from 5 to 25° C. below the glass transition temperature of the binder.

2. A process as claimed in claim 1 wherein the self-dispersed polyester resin particles are obtained by a polyester dispersion process which includes the steps of: mixing a polyester resin having an acid value greater than 5 mg KOH/g, an organic solvent and water; and removing the organic solvent to form an aqueous dispersion of self-dispersed polyester resin particles.

3. A process as claimed in claim 2 wherein the aqueous dispersion of self-dispersed polyester resin particles contains an amount of residual organic solvent which is less than 500 ppm by weight.

4. A process according to claim 1 wherein the polyester resin is carboxy functional.

5. A process according to claim 1 wherein the polyester resin does not contain any sulphonic acid or sulphonate groups.

6. A process according to claim 1 wherein the mean size of the polyester resin particles is 40 to 150 nm.

7. A process according to claim 1 wherein the polyester resin is a blend of two or more polyester resins of different molecular weight.

8. A process according to claim 1 wherein the polyester resin has an acid value of from 10 to 50 mg KOH/g.

9. A process according to claim 1 wherein the ionic surfactant is a carboxy functional surfactant.

10. A process according to claim 9 wherein the ionic surfactant is a fatty acid carboxylate, or an alkyl or aryl alkoxylated carboxylate.

11. A process according to claim 1 which comprises associating further particles with the polyester resin particles and colorant particles, said further particles being selected from wax, charge control agent and non-polyester resins.

12. A process according to claim 1 wherein the neutralised acid groups on the polyester resin and ionic surfactant comprise a carboxylate group, and the aqueous dispersion is provided with a pH of from 7 to 10, the association being effected by the addition of an acid which decreases the pH to below 4 and converts the neutralised acid groups on the polyester resin and the ionic surfactant from their more dispersion stabilising ionic carboxylate form to their less stabilising non-ionic carboxylic acid form.

13. A process as claimed in claim 1 further comprising a step of raising the temperature from 15 to 40° C. above the Tg of the binder resin to fuse the aggregates to form toner particles.

14. A process according to claim 13 wherein the toner particles are recovered, washed and dried and then blended with one or more surface additives.

15. A process as claimed in claim 14 which additionally comprises mixing the toner particles with a magnetic carrier to form a two component developer.

* * * * *